US007201119B2

(12) United States Patent
Tawarada et al.

(10) Patent No.: US 7,201,119 B2
(45) Date of Patent: Apr. 10, 2007

(54) VEHICULAR POWER UNIT

(75) Inventors: Yuichi Tawarada, Saitama (JP); Eiko Shiozaki, Saitama (JP); Hiroyuki Kawakubo, Saitama (JP); Kazuyuki Nakai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/389,148

(22) Filed: Mar. 27, 2006

(65) Prior Publication Data

US 2006/0213464 A1 Sep. 28, 2006

(30) Foreign Application Priority Data

Mar. 28, 2005 (JP) ..... 2005-092402
Sep. 30, 2005 (JP) ..... 2005-285799
Sep. 30, 2005 (JP) ..... 2005-287125

(51) Int. Cl.
*F01P 5/10* (2006.01)
*F02F 1/10* (2006.01)
*F02B 61/04* (2006.01)

(52) U.S. Cl. ..... 123/41.44; 123/195 R; 123/198 R; 180/346

(58) Field of Classification Search ..... 123/41.44, 123/41.47, 195 R, 198 R, 198 E; 180/346; 474/144

See application file for complete search history.

(56) References Cited

U.S. PATENT DOCUMENTS

| | | | | |
|---|---|---|---|---|
| 4,566,577 | A | 1/1986 | Tsuboi et al. | |
| 5,199,395 | A | 4/1993 | Mizumura et al. | |
| 5,445,568 | A * | 8/1995 | Fukuzawa et al. | 474/144 |
| 2001/0050193 | A1 | 12/2001 | Yoshida et al. | |
| 2004/0244761 | A1 | 12/2004 | Takeuchi | |
| 2004/0247444 | A1 | 12/2004 | Oshita et al. | |

FOREIGN PATENT DOCUMENTS

| | | | |
|---|---|---|---|
| EP | 1477658 | A | 11/2004 |
| JP | 7-17699 | U | 3/1995 |
| JP | 3227972 | B2 | 9/2001 |
| JP | 7017699 | U | 3/2006 |

* cited by examiner

*Primary Examiner*—Noah P. Kamen
(74) *Attorney, Agent, or Firm*—Birch, Stewart, Kolasch & Birch, LLP

(57) ABSTRACT

A vehicular power unit including a drive-side transmission sprocket wheel provided on an end of an output shaft that protrudes from one side of a crankcase, an endless transmission belt for transmitting power to a driving wheel wound the sprocket wheel. The endless transmission belt transmits power from the crankshaft to a transmission housed in the crankcase. A water pump is arranged on the same side of the crankcase in a position between the crankshaft and the output shaft. Further, the water pump is disposed inside the drive-side transmission sprocket wheel in a direction along the axis of an output shaft. This configuration enables the vehicular power unit to be formed in a compact size in a direction along an axis of a crankshaft.

20 Claims, 15 Drawing Sheets

VEHICULAR POWER UNIT

CROSS-REFERENCE TO RELATED APPLICATION

The present application claims priority under 35 U.S.C. §119 to Japanese Patent Application No. 2005-287125, filed Sep. 30, 2005, Japanese Patent Application No. 2005-092402, filed Mar. 28, 2005, and Japanese Patent Application No. 2005-285799, filed Sep. 30, 2005, the entire contents of which are hereby incorporated by reference.

BACKGROUND OF THE INVENTION

1. Field of the Invention

The present invention relates to a vehicular power unit provided with an engine in which a crankshaft is rotatably supported by a crankcase and a transmission housed in the crankcase for shifting power transmitted from the crankshaft. A drive-side transmission sprocket wheel, onto which an endless transmission belt for transmitting power to a driving wheel is wound, is provided on an end of an output shaft of the transmission protruding from one side of the crankcase. In addition, a water pump is arranged on the same side of the crankcase in a position between the crankshaft and the output shaft. The vehicular power unit also includes a crankshaft to which a generator is attached, and a transmission having an output shaft for transferring power to a driving wheel is attached. An output retrieving member composing an output transfer mechanism is attached to the output shaft.

2. Description of Background Art

A conventional vehicular power unit including a water pump arranged between an output shaft of a transmission and a crankshaft arranged on one side of a crankcase is shown, for example, by JP Patent No. 3227972.

However, in the power unit disclosed in the JP Patent No. 3227972, a part of the water pump is arranged on a plane including a chain wound onto a drive sprocket provided to the output shaft of the transmission, the protruded amount of the water pump from one side of the crankcase is increased, and the power unit is prevented from being made compact.

Another, conventional power unit having a crankshaft to one end of which on one side a generator is attached, a transmission having an output shaft to one end of which on one side a drive sprocket is attached, and the crankshaft and the output shaft directed in the vehicle width direction are disposed in parallel with each other (See for example, JP-U No. 17699/1995).

In a power unit wherein a crankshaft and an output shaft are disposed in parallel with each other at an interval in an anteroposterior direction, when it is intended to shorten the distance between the crankshaft and the output shaft and downsize the power unit in the anteroposterior direction, a crankcase cover which covers a generator and a chain cover which covers a drive sprocket interfere with each other and hence the downsizing of the power unit is restricted in the anteroposterior direction. Further, a generator attached to a crankshaft functions as a rotary inertial mass to suppress the rotational fluctuation of the crankshaft and, when it is attempted to increase the diameter of the rotor of the generator in order to increase the rotary inertial mass without increasing the weight of the generator, a crankcase cover and a chain cover interfere with each other.

SUMMARY AND OBJECTS OF THE INVENTION

The invention is made in view of such a situation and one object is to provide a vehicular power unit that can be made compact in a direction along an axis of a crankshaft. Another object of the invention is to downsize the power unit by disposing a crankshaft and an output shaft parallel with each other at an interval in the arranging direction. Additional objects of the invention include effectively suppressing the rotational fluctuation of a crankshaft with a generator while preventing the weight of the generator from increasing and increasing the versatility of a traveling guide for guiding an endless transmission belt.

According to a first aspect of the present invention, a vehicular power unit provided with an engine in which a crankshaft is rotatably supported by a crankcase, and a transmission housed in the crankcase for shifting power transmitted from the crankshaft. A drive-side transmission sprocket wheel, onto which an endless transmission belt for transmitting power to a driving wheel is wound is provided to the end protruded from one side of the crankcase of an output shaft of the transmission. A water pump, arranged between the crankshaft and the output shaft, is arranged on one side of the crankcase. Further, the water pump is arranged inside the drive-side transmission sprocket wheel in a direction along the axis of the output shaft. Since the water pump is arranged inside the drive-side transmission sprocket wheel, the water pump is not protruded outside from the drive-side transmission sprocket wheel. Further, the power unit can be made compact in the direction along the axis of the crankshaft, and the concentration of mass can contribute to the enhancement of the driving performance of the vehicle.

According to a second aspect of the present invention, a cover at least a part of which is overlapped with the water pump from the outside when the cover is viewed from a direction along the axis of the output shaft is attached to the crankcase, covering the drive-side transmission sprocket wheel. Since the output shaft of the transmission and the water pump can be closely arranged and accessories can be concentrated three-dimensionally, mass can be concentrated more.

According to a third aspect of the present invention, an input shaft of the transmission is arranged over a straight line tying the axis of the crankshaft and the axis of the output shaft. Accordingly, distance between the input shaft of the transmission and the crankshaft can be reduced and the power unit can be made compact in the direction along the straight line tying the axis of the crankshaft and the axis of the output shaft. In addition, as the water pump is arranged inside the drive-side transmission sprocket wheel, a position of the water pump from the bottom of the crankcase is lifted and the lower part of the crankcase can be made compact. In the case wherein the water pump is driven by the transmission of power from the crankshaft, the input shaft or the output shaft of the transmission, the crankshaft, the input shaft or the output shaft of the transmission and the pump shaft of the water pump can be closely arranged. Further, the distance of coupling by the driving member such as a chain and a gear is reduced, and the weight can be reduced.

According to a fourth aspect of the present invention, an extended-diameter head of a bolt arranged in a position overlapped with the endless transmission belt on a projection drawing showing a plane perpendicular to the axis of the output shaft out of plural bolts for mutually fastening a pair of case halves forming a pump case of the water pump is arranged on the side of the crankcase. Since the pair of the case halves forming the pump case are mutually fastened by the plural bolts and the extended-diameter head of the bolt arranged in a position overlapped with the endless transmission belt on the projection drawing showing the plane perpendicular to the axis of the output shaft is arranged on the side of the crankcase, the endless transmission belt and the pump case can be arranged closer. This prevents the extended-diameter head of the bolt from interfering with the endless transmission belt and the power unit can be made more compact in the direction along the axis of the output shaft.

According to a fifth aspect of the present invention, a fitting support fitted to the crankcase so that the fitting support can be inserted/removed in a direction parallel to the axis of the output shaft is provided to the pump case, and at least a part of the pump case is protruded below a connection face of the crankcase and an oil pan when it is viewed from a direction along the axis of the output shaft.

Since the water pump is arranged inside the endless transmission belt, the access of a tool to the water pump is limited. However, as at least a part of the pump case is protruded below the connection face of the crankcase and the oil pan, the pump case can be removed from the crankcase by applying force in a direction for removing the fitting support from the crankcase to the part protruded below the connection face out of the pump case in a state in which the oil pan is removed from the crankcase even if the fitting support of the pump case is fitted to the crankcase. Thus, the maintainability of the water pump is enhanced.

According to the sixth aspect of the present invention, a generator is attached to one side end of a crankshaft in the axial direction a; a transmission is provided with an output shaft for outputting the transmitted power of the crankshaft; and a power unit case houses the crankshaft and the output shaft. The crankshaft and the output shaft are disposed in parallel with each other at an interval in the arranging direction orthogonal to the axial direction. An output retrieving member, composing an output transfer mechanism for transferring the power from the output shaft to a driving wheel, is disposed at the one side end of the output shaft. In addition, a generator cover for covering the generator facing the sidewall on the one side of the power unit case and a protective cover for covering the output retrieving member facing the sidewall are disposed at positions where they partially overlap with each other in the arranging direction on a side view.

By so doing, the generator cover and the protective cover have parts overlapping with each other in the arranging direction and hence it is possible to shorten the distance between the crankshaft and the output shaft by the length corresponding to the overlapping parts in the arranging direction. That is, since the distance between the crankshaft and the output shaft is reduced in the arranging direction, the power unit wherein the crankshaft and the output shaft are disposed in parallel with each other at an interval in the arranging direction can be downsized in the arranging direction.

According to the seventh aspect of the present invention, the output transfer mechanism is composed of a driving wheel which is the output retrieving member, an endless transmission belt wound on the driving wheel, and a traveling guide for guiding the endless transmission belt; and the traveling guide is disposed at a position where it partially overlaps with the generator cover in the arranging direction on a side view.

By so doing, it is possible to approximate the output shaft to the crankshaft in the arranging direction until the generator cover and the traveling guide have parts overlapping with each other in the arranging direction. That is, since the distance between the crankshaft and the output shaft is reduced in the arranging direction until the generator cover and the traveling guide have parts overlapping with each other, the power unit can be downsized in the arranging direction.

According to the eighth aspect of the present invention, the protective cover or the traveling guide has a retracted section of a shape retracting toward the output shaft at an arcuate part opposing the crankshaft in the arranging direction in order to avoid interfering with the chamber wall of a crank chamber in which the crankshaft is housed.

By so doing, it is possible to: dispose the protective cover or the traveling guide closer to the sidewall of the crank chamber by utilizing the space formed by the retracted section; and thereby approximate the output shaft to the crankshaft in the arranging direction. That is, since the distance between the crankshaft and the output shaft is further reduced in the arranging direction by utilizing the space formed by the retracted section, the power unit can further be downsized in the arranging direction.

According to the ninth aspect of the present invention, the outer diameter of the rotor of the generator is larger than the outer diameter of the crank webs of the crankshaft; and the output retrieving member or the driving wheel is disposed between a pair of bearing supports for respectively supporting a pair of journals disposed so as to interpose the crank webs of the crankshaft which belong to the cylinder adjacent to the generator at a position in the axial direction.

By so doing, the outer diameter of the rotor of the generator increases and thereby it is possible to: increase power generation capacity; and suppress the rotational fluctuation of the crankshaft with the generator as the rotary inertial mass while the weight of the generator is prevented from increasing or reduced. It is further possible to approximate the output shaft to the crankshaft in the arranging direction by utilizing the crank webs smaller than the rotor. That is, since the rotational fluctuation of the crankshaft is effectively suppressed with the generator and moreover the distance between the crankshaft and the output shaft is reduced in the arranging direction by utilizing the crank webs which are smaller than the rotor of the generator while the weight of the generator is prevented from increasing or reduced, the power unit can be downsized in the arranging direction.

According to the tenth aspect of the present invention, the traveling guide has a wide width part at a position where it overlaps with the unwinding section or the winding section of the endless transmission belt in the direction of the circumference around the rotation center line of the driving wheel; the distance between the endless transmission belt and the wide width part on a half straight line extending from the rotation center line through the unwinding section or the winding section is smaller than the width of the wide width part on the half straight line on a side view; and a window is formed at the wide width part.

By so doing, the distance between the traveling guide and the endless transmission belt is reduced by the wide width part and hence, even when an identical power unit is mounted on a different vehicle and the mounting angle of the internal combustion engine on the vehicle body is changed, the increase of the distance between the unwinding section or the winding section and the traveling guide on the half straight line is suppressed and therefore the guide function of the traveling guide is secured. Further, since the window is formed at the wide width part, the weight of the traveling guide having the wide width part is reduced. That is, since the guide function of the traveling guide is secured by the identical traveling guide even when the mounting angle of the internal combustion engine on the vehicle body is changed, the versatility of the traveling guide is enhanced and the cost of the power unit can be reduced. Further, the weight of the traveling guide having the wide width part can be reduced by the window.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
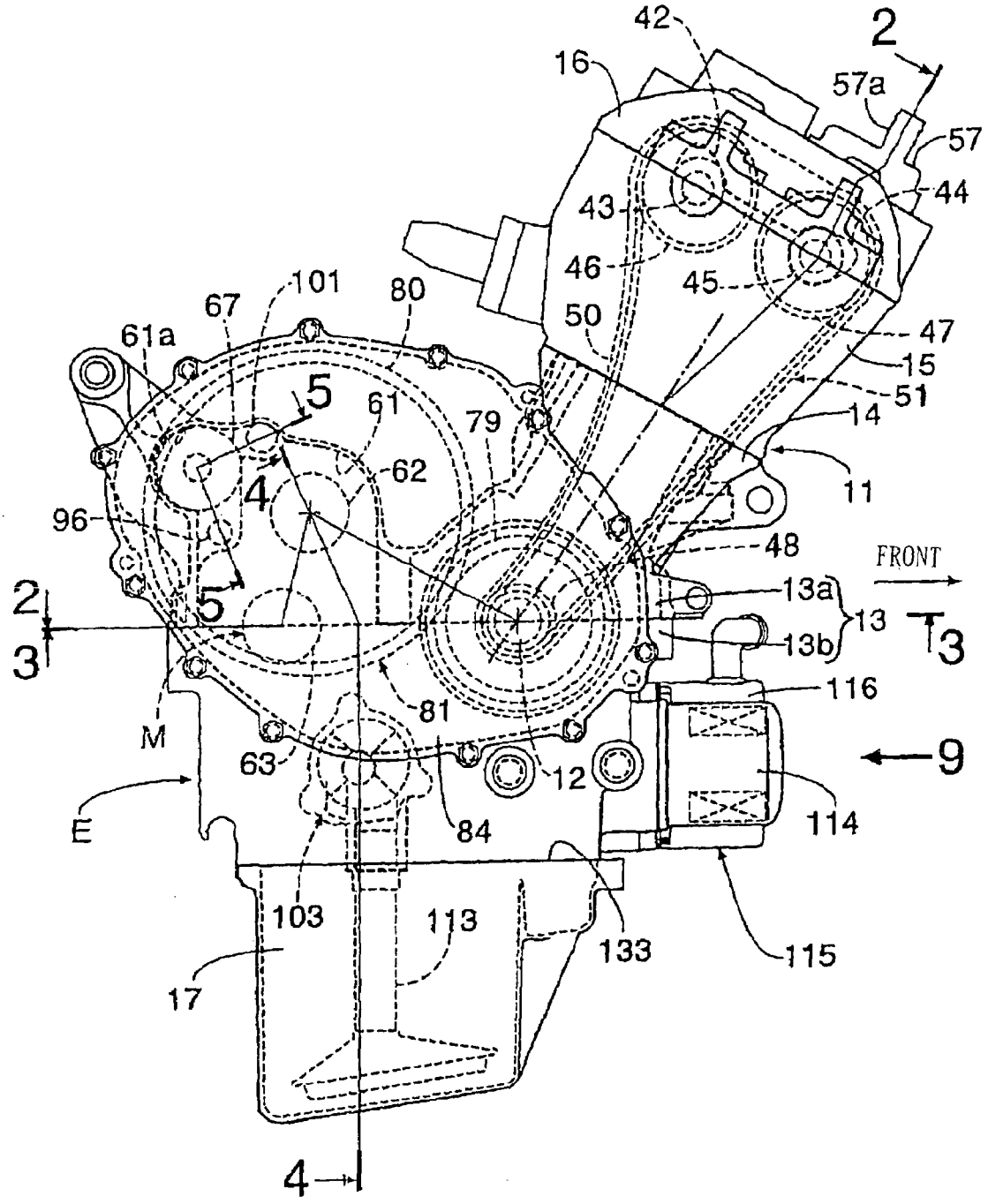
FIG. 1 is a side view showing a power unit.

FIGS. 1 to 9 show one embodiment of the invention. First, as shown in FIG. 1, this power unit is mounted in a vehicle, for example, a motorcycle, and is provided with an in-line 4-cylinder water-cooled engine E for example and a constant-mesh type gear transmission M that shifts the output of the engine E.

A body 11 of the engine E is provided with: a crankcase 13 for rotatably supporting a crankshaft 12 having an axis extended in a lateral direction of the motorcycle; a cylinder block 14 coupled to the crankcase 13 on the front side in a traveling direction of the motorcycle; a cylinder head 15 coupled to the upper end of the cylinder block 14; and a head cover 16 coupled to the upper end of the cylinder head 15. An oil pan 17 is coupled to a lower part of the crankcase 13.

The crankcase 13 is formed by mutually connecting an upper case 13*a* and a lower case 13*b* respectively cast and the crankshaft 12 is rotatably supported between the upper case 13*a* and the lower case 13*b*.

Figure 2:
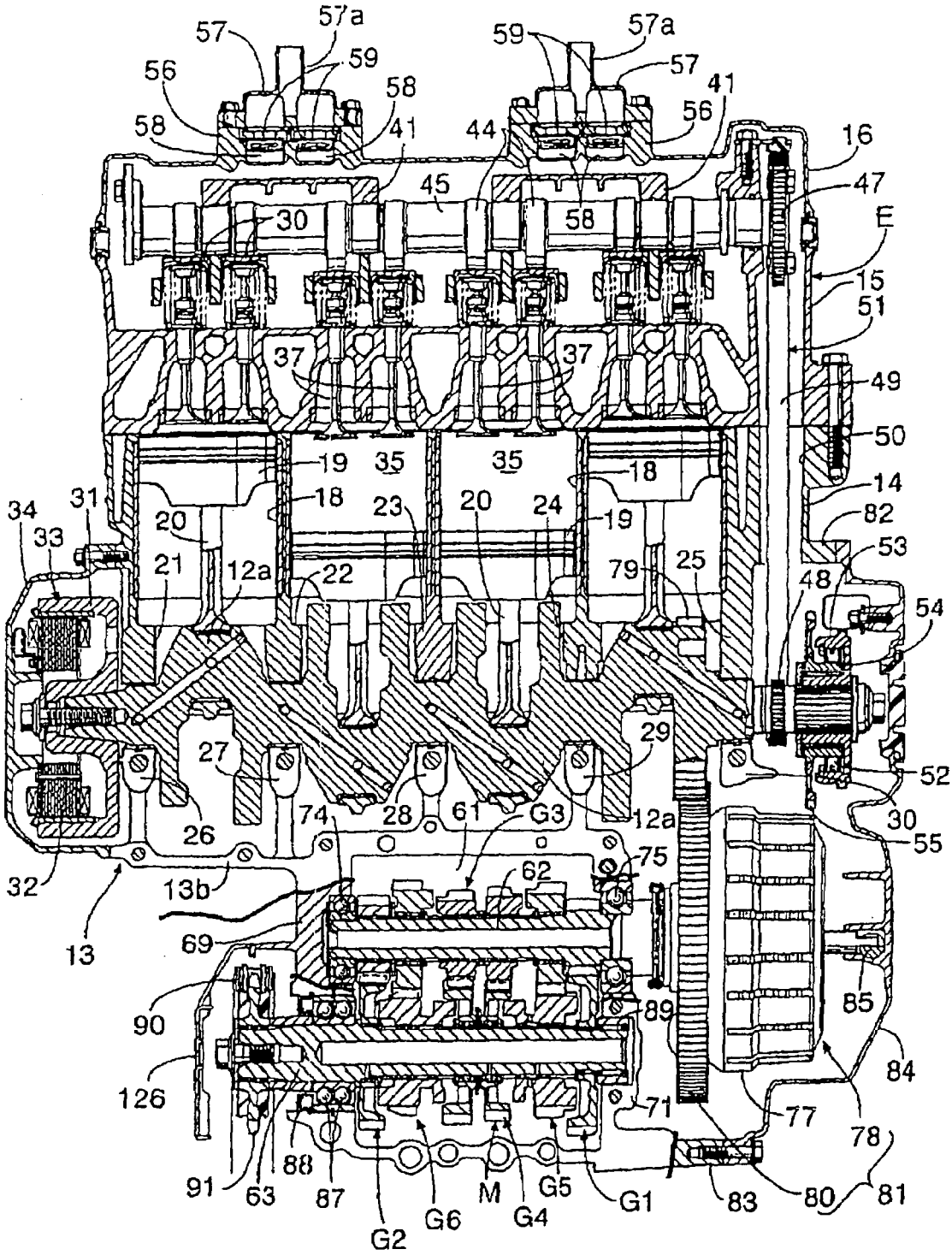
FIG. 2 is a sectional view taken along a line 2—2 shown in FIG. 1.

Also referring to FIG. 2, the cylinder block 14 is integrated with the upper case 13*a* of the crankcase 13 in a state that the cylinder block is inclined forwardly and upwardly in the traveling direction of the motorcycle, four cylinder bores 18 arranged along the axis of the crankshaft 12 are provided to the cylinder block 14, and each piston 19 slidably fitted into each cylinder bore 18 is coupled to each crankpin 12*a* disposed in the crankshaft 12 via each connecting rod 20.

Figure 3:
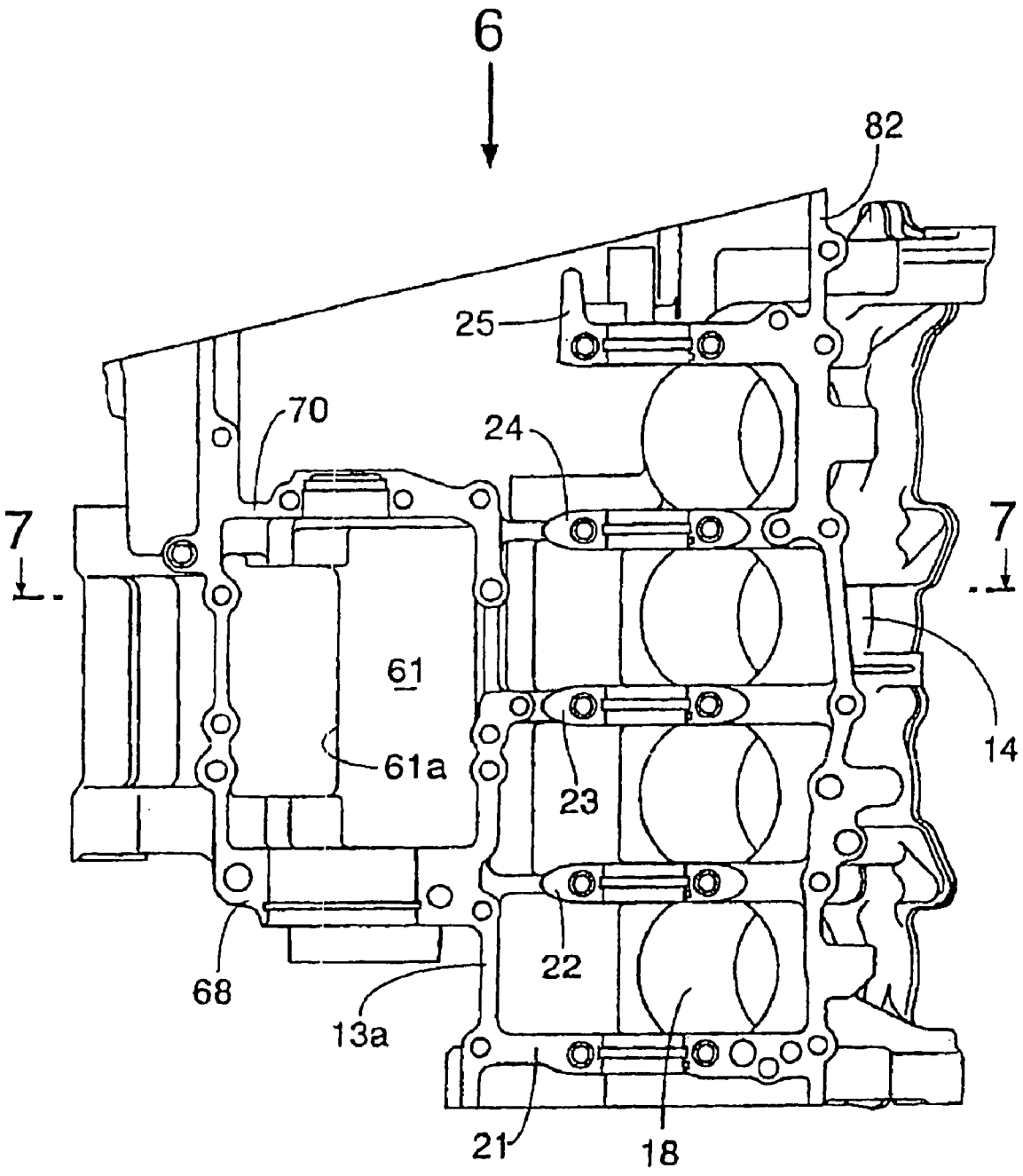
FIG. 3 is a bottom view showing an upper case taken in the direction of arrows along a line 3—3 shown in FIG. 1.

Also referring to FIG. 3, five pieces of first to fifth upper journal walls 21 to 25 arranged mutually at an interval from the left side to the right side along the axis of the crankshaft 12 in a state in which the power unit is mounted in the motorcycle are provided to the upper case 13*a* of the crankcase 13. First to fifth lower journal walls 26 to 30 corresponding to the first to fifth upper journal walls 21 to 25 are provided to the lower case 13*b* in a state in which the first to fifth lower journal walls are connected to the corresponding first to fifth upper journal walls 21 to 25 as shown in FIG. 2, and the crankshaft 12 is rotatably supported between bonded faces of the upper and lower cases 13*a*, 13*b*, that is, between the corresponding bonded faces of the first to fifth upper journal walls 21 to 25 and the first to fifth lower journal walls 25 to 30 so that the crankshaft can be rotated.

An outer rotor 31 is fixed to one end of the crankshaft 12 protruded outside from the left side wall of the crankcase 13, that is, from the first upper and lower journal walls 21, 26 and an inner rotor 32 configuring a generator 33 together with the outer rotor 31 is attached to a generator cover 34 fastened to the left wall of the crankcase 13 for covering the generator 33.

As shown in FIG. 2, each combustion chamber 35 is formed opposite to the top of each piston 19 slidably fitted into each cylinder bore 18 between the cylinder block 14 and the cylinder head 15, and a pair of exhaust valves 37 are openably and closably arranged on every combustion chamber 35 in the cylinder head 15, being pressed by each spring in a valve closing direction. Each bottomed cylindrical exhaust valve side lifter 39 for making the inner face of the closed end abut on the top of each exhaust valve 37 is fitted to the cylinder head 15 so that the lifter can be slid in the opened or closed direction of each exhaust valve 37. Besides, in the cylinder head 15, like the exhaust valves, a pair of intake valves (not shown) are openably and closably arranged on every combustion chamber 35, being pressed by each spring in a valve closing direction, and a bottomed cylindrical intake valve side lifter (not shown) for making the inner face of the closed end abut on the top of each intake valve is fitted to the cylinder head 15 so that the lifter can be slid in the opened or closed direction of the intake valve.

An exhaust-side cam shaft 45 provided with plural exhaust-side cams 44 which are in sliding contact with the outside face of the closed end of each exhaust valve side lifter 39, is rotatably supported around the axis parallel to the crankshaft 12 by the cylinder head 15 and exhaust-side cam holders 41, 41 fastened to the cylinder head 15. An intake-side camshaft 43 (see FIG. 1) provided with plural intake-side cams 42 (see FIG. 1) which are in sliding contact with the outside face of the closed end of each intake valve side lifter, is rotatably supported around the axis parallel to the crankshaft 12 by the cylinder head 15 and an intake-side cam holder (not shown) fastened to the cylinder head 15 so that the camshaft can be rotated in parallel with the crankshaft.

The rotational power of the crankshaft 12 is transmitted to the intake-side camshaft 43 and the exhaust-side camshaft 45 via timing transmission means 51, the timing transmission means 51 is provided with: an intake side driven sprocket 46 and an exhaust side driven sprocket 47 which are fixed to the right ends of the intake side camshaft 43 and the exhaust side camshaft 45; a driving sprocket 48 provided to the crankshaft 12 outside the fifth upper and lower journal walls 25, 30; and a looped cam chain 49 wound onto the driving sprocket 48, the exhaust side driven sprocket 47 and the intake side driven sprocket 46. A chain passage 50 for making the cam chain 49 travel therein is formed in the cylinder block 14, the cylinder head 15 and the head cover 16 on the side of the other end of the crankshaft 12.

A one-way clutch 52 including: a clutch outer 53 in which relative rotation with the crankshaft 12 is impossible; and a clutch inner 54 in which relative rotation with the crankshaft 12 is enabled and that is provided with a driven gear 55 to which power from a starting motor not shown is input; is installed on the other end of the crankshaft 12 outside the driving sprocket 48, and the one-way clutch 52 enables only the transmission of power from the clutch inner 54 to the clutch outer 53, that is, from the starting motor to the side of the crankshaft 12.

A pair of left and right mounting cylinders 56, 56 corresponding to a pair of cylinders located on the left side in a state mounted in the motorcycle and a pair of cylinders located on the right side are protruded from the head cover 16, and caps 57 are respectively fastened to the mounting cylinders 56.

Each secondary air passage 58 individually opened to an exhaust port of each cylinder is independently formed in each mounting cylinder 56, and each reed valve 59 individually corresponding to each secondary air passage 58 is held between each mounting cylinder 56 and each cap 58. In addition, a connecting tube 57*a* for connecting a pipe for leading lightened secondary air from an air cleaner not shown is integrated with each cap 58.

Figure 4:
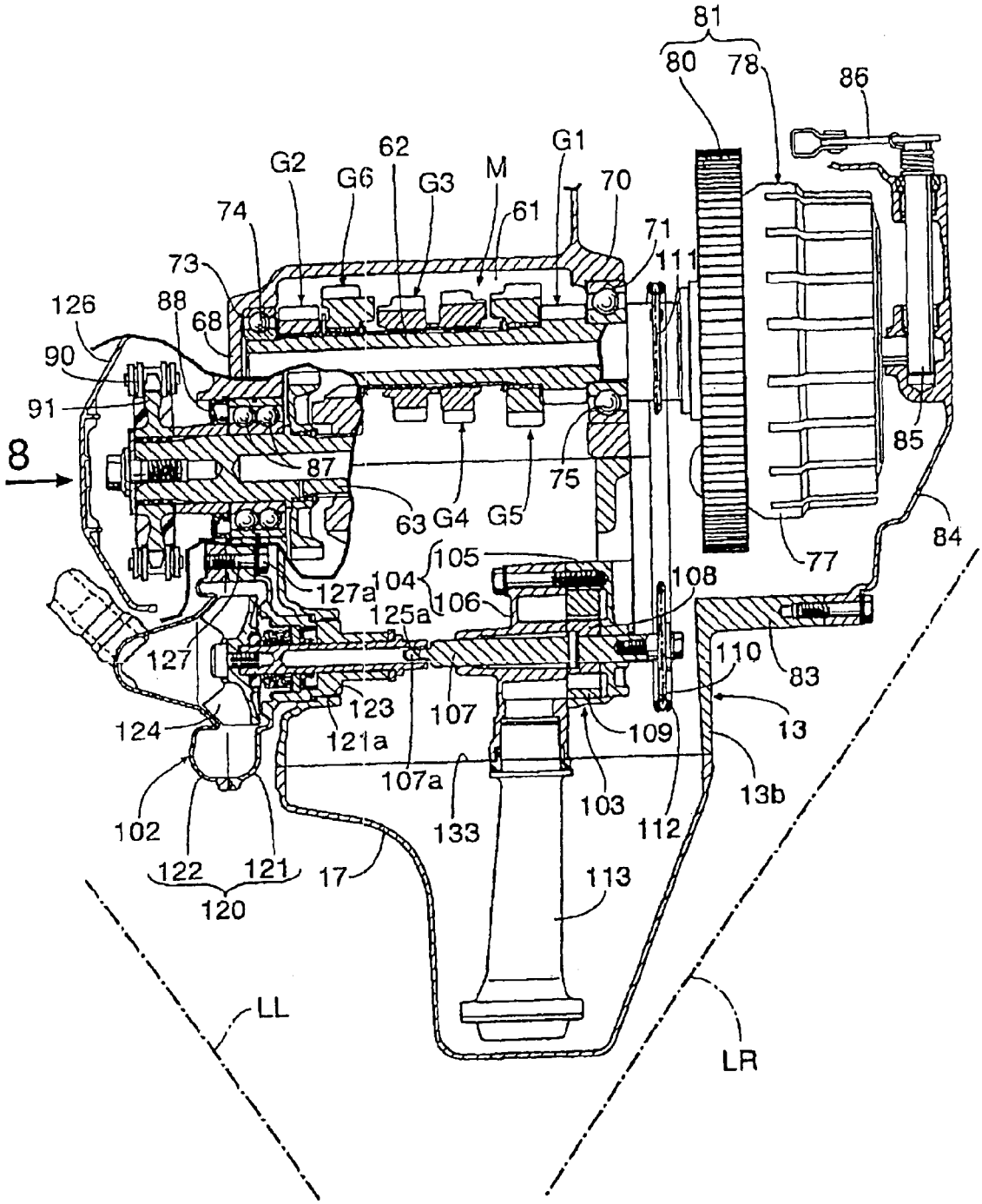
FIG. 4 is an enlarged sectional view taken along a line 4—4 shown in FIG. 1.
Figure 5:
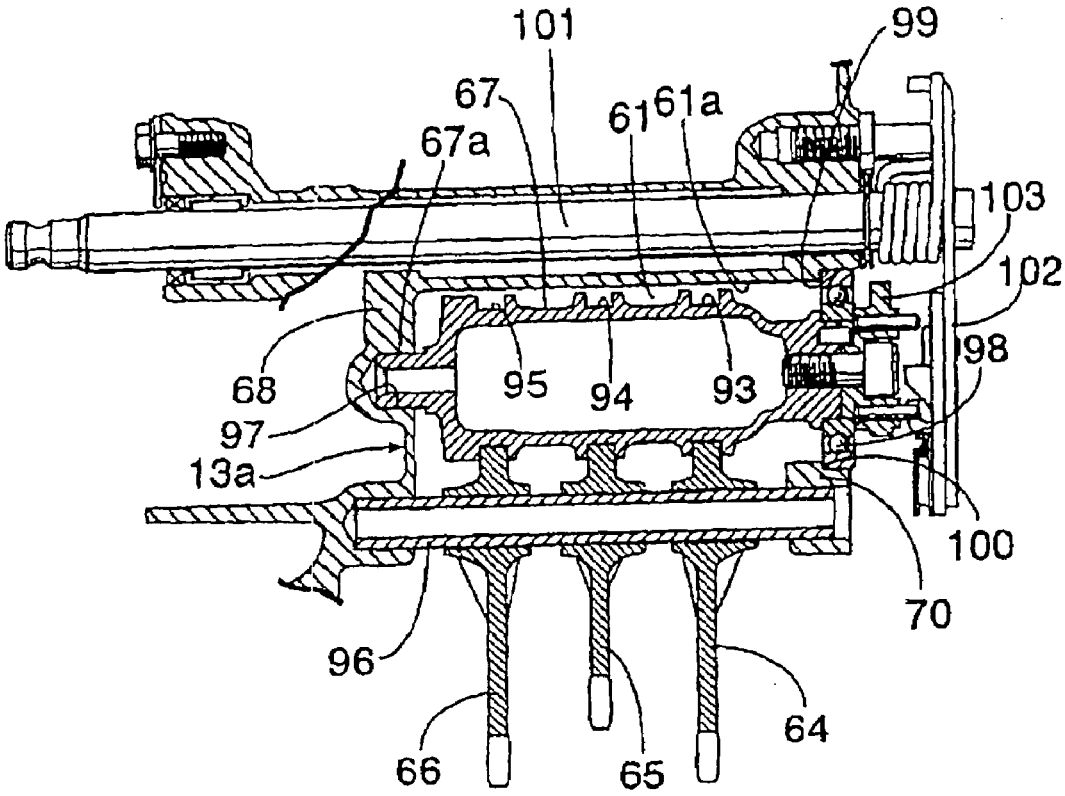
FIG. 5 is an enlarged sectional view taken along a line 5—5 shown in FIG. 1.

Also referring to FIGS. 4 and 5, a transmission chamber 61 is formed at the back of the crankshaft 12 in the state mounted in the motorcycle in the crankcase 13 and a main part of a gear transmission M is housed in the transmission chamber 61.

The gear transmission M is provided with: a main shaft 62 as an input shaft having an axis parallel to the crankshaft 12; a counter shaft 63 as an output shaft having an axis parallel to the main shaft 62; plural shift means provided between the main shaft 62 and the counter shaft 63 so that each means can be selectively established, for example, six-stage first to sixth speed gear trains G1 to G6; three shift forks 64, 65, 66 for selectively establishing the first to sixth speed gear trains G1 to G6; and a shift drum 67 for driving the shift forks 64 to 66. Most of the main shaft 62, the counter shaft 63 and the shift drum 67 are housed in the transmission chamber 61, and the first to sixth speed gear trains G1 to G6 and the shift forks 64 to 66 are housed in the transmission chamber 61 so that they can be operated.

In the upper and lower cases 13*a*, 13*b* of the crankcase 13, upper and lower left supporting walls 68, 69 forming a left end wall of the transmission chamber 61 in the state mounted in the motorcycle are connected in positions substantially corresponding to the second upper and lower journal walls 22, 26, upper and lower right supporting walls 70, 71 forming a right end wall of the transmission chamber 61 in the state mounted in the motorcycle are connected in positions substantially corresponding to the fourth upper and lower journal walls 24, 29, and the upper and lower left supporting walls 68, 69 are arranged inside a part supporting the crankshaft 12 of the left wall of the crankcase 13 along the axis of the crankshaft 12.

Figure 6:
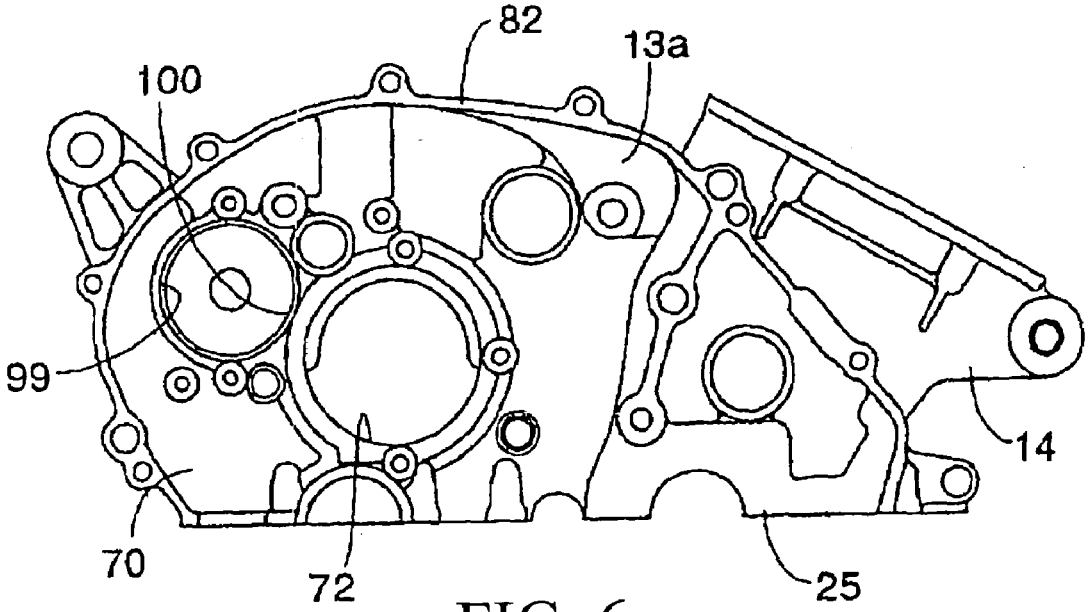
FIG. 6 is a view taken in a direction of an arrow 6 in FIG. 3.
Figure 7:
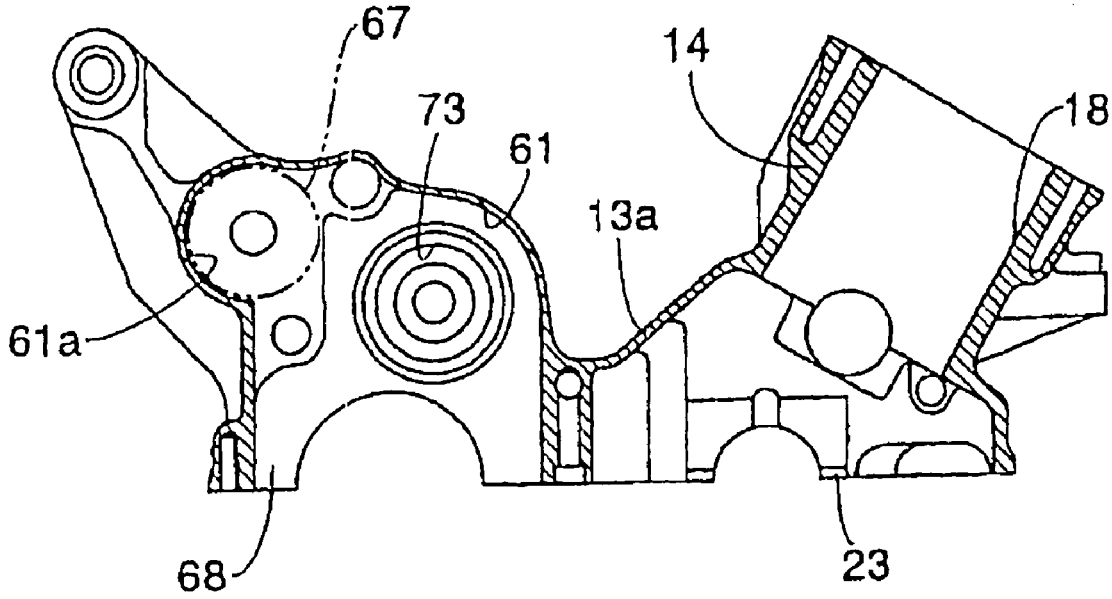
FIG. 7 is a sectional view taken along a line 7—7 shown in FIG. 3.

Also referring to FIGS. 6 and 7, a supporting hole 72 for rotatably penetrating the main shaft 62 is provided to the right upper supporting wall 70 of the upper case 13*a* and a supporting recessed portion 73 which is coaxial with the supporting hole 72 is provided to the left upper supporting wall 68. A ball bearing 74 is interposed between the outside periphery at one end of the main shaft 62 and the inside circumference of the supporting recessed portion 73 and a ball bearing 75 is interposed between the inside circumference of the supporting hole 72 and the main shaft 62. That is, one end of the main shaft 62 is rotatably supported by the left upper supporting wall 68, an intermediate part of the main shaft 62 is rotatably supported by the right upper supporting wall 70, and the other end of the main shaft 62 is protruded outside the right upper supporting wall 70, that is, outside the right side of the crankcase 13.

A clutch 78 which is provided with a clutch inner (not shown) in which relative rotation with the main shaft 62 is impossible and a clutch outer 77 in which relative rotation with the main shaft 62 is enabled, and which is formed in a conventional well-known multiple disc type is installed at the other end of the main shaft 62, a primary driven gear 80 forming a clutch mechanism 81 together with the clutch 78 is coupled to the clutch outer 77 via a damper spring not shown, and a primary driving gear 79 provided to the crankshaft 12 inside the fifth upper and lower journal walls 25, 30 is engaged with the primary driven gear 80 as definitely shown in FIG. 2. In addition, the maximum outer diameter of the clutch mechanism 81 is formed by the primary driven gear 80.

Extended wall parts 82, 83 extended rightward to form a cylinder for encircling the clutch 78 and the one-way clutch 52 in collaboration are provided to the upper and lower cases 13*a*, 13*b* in the crankcase 13, and a right cover 84 for covering the clutch 78 and the one-way clutch 52 is fastened to the extended wall parts 82, 83. In addition, the extended wall parts 82, 83 and the right cover 84 are bonded so that they have a plane inclined inside along the axis of the crankshaft 16 in a lower part.

An operating shaft 85 for switching disconnection/connection of the clutch 78 is rotatably supported by the right cover 84 and a release lever 86 is provided to the end protruded from the right cover 84 of the operating shaft 85.

The counter shaft 63 is rotatably supported between the bonded faces of the upper case 13*a* and the lower case 13*b* forming the crankcase 13, and is arranged on the rear side of the crankshaft 12. One end of the counter shaft 63 is outwardly protruded to the left side from the left upper supporting wall 68 and the left lower supporting wall 69, and ball bearings 87 and a circular sealing member 88 arranged outside the ball bearings 87 are interposed between the left upper supporting wall 68 and the counter shaft 63 and between the left lower supporting wall 69 and the counter shaft 63. The other end of the counter shaft 63 is rotatably supported by the right upper supporting wall 70 and the right lower supporting wall 71 via a needle bearing 89.

The main shaft 62 is rotatably supported by the upper case 13*a* out of the upper and lower cases 13*a*, 13*b* respectively forming the crankcase 13, while the crankshaft 12 and the counter shaft 63 are rotatably supported between the upper and lower cases 13*a*, 13*b*, and the main shaft 62 is arranged over a straight line tying the axis of the crankshaft 12 and an axis of the counter shaft 63, that is, over the bonded faces of the upper and lower cases 13*a*, 13*b*.

A driving sprocket 91 which is a drive-side transmission sprocket wheel is provided to one end of the counter shaft 63 outwardly protruded to the left side from the left upper supporting wall 68 and the left lower supporting wall 69 and a chain 90 which is an endless transmission belt for transmitting power to a rear wheel which is a driving wheel is wound onto the driving sprocket 91.

As shown in FIG. 5, both ends of the shift drum 67 are rotatably supported by the left and right upper supporting walls 68, 70 of the upper case 13*a* in the crankcase 13, and the shift forks 64 to 66 fitted into three fitting grooves 93, 94, 95 provided to the outside face of the shift drum 67 are supported in common by a single spindle 96 having an axis parallel to the shift drum 67 and provided between the left and right upper supporting walls 68, 70 so that the shift forks can be slid in an axial direction of the spindle.

A small-diameter shaft 67*a* is coaxially and integrally protruded from one end of the shift drum 67 and is rotatably fitted into a supporting recessed portion 97 provided to the left upper supporting wall 68. In addition, the shift drum 67 is attached to the crankcase 13 from the side of the clutch mechanism 81 installed at the right end of the crankshaft 12, and a supporting hole 99 for fitting a ball bearing 98 installed on the outer periphery of one end on the side of the clutch 78 of the shift drum 67 and a receiving flange 100 extended inside in a radial direction from the inner end of the supporting hole 99 to receive the inner end of an outer ring of the ball bearing 98 from the side of the clutch 78 are coaxially formed on the right upper supporting wall 70 of the upper case 13*a*.

The shift drum 67 is arranged in the maximum outer diameter of the clutch mechanism 81 on a projection drawing showing a plane perpendicular to an axis of the main shaft 62 as shown in FIG. 1, a shift drum chamber 61a forming a part of the transmission chamber 61 and housing most of the shift drum 67 is formed in the rear of the upper case 13*a* in the crankcase 13 in a state in which the shift drum chamber semicircularly swells toward the rear side of the crankcase 13 when the shift drum chamber is viewed from an axial direction of the shift drum 67, and a wall forming the shift drum chamber 61*a* is also substantially housed in the maximum outer diameter of the clutch mechanism 81, that is, in the outer diameter of the primary driven gear 80 on the projection drawing showing the plane perpendicular to the axis of the main shaft 62. In addition, the shift drum chamber 61*a* has the same diameter as the inner diameter of the receiving flange 100 formed on the right upper supporting wall 70 and is cast out when the upper case 13*a* is cast. An upper part of the transmission chamber 61 formed in the upper case 13*a* is overlapped with the clutch mechanism 81 on the projection drawing showing the plane perpendicular to the axis of the main shaft 62 as shown in FIG. 1.

A shift shaft 101 one end of which is protruded leftward from the upper case 13*a* is rotatably supported by the upper case 13*a* and one end of a shift arm 102 is provided to the other end of the shift shaft 101. A shift cam 103 is provided to the other end of the shift drum 67 and the other end of the shift arm 102 is fitted to the shift cam 103 to turn the shift drum 67 according to the turning of the shift shaft 101.

Figure 8:
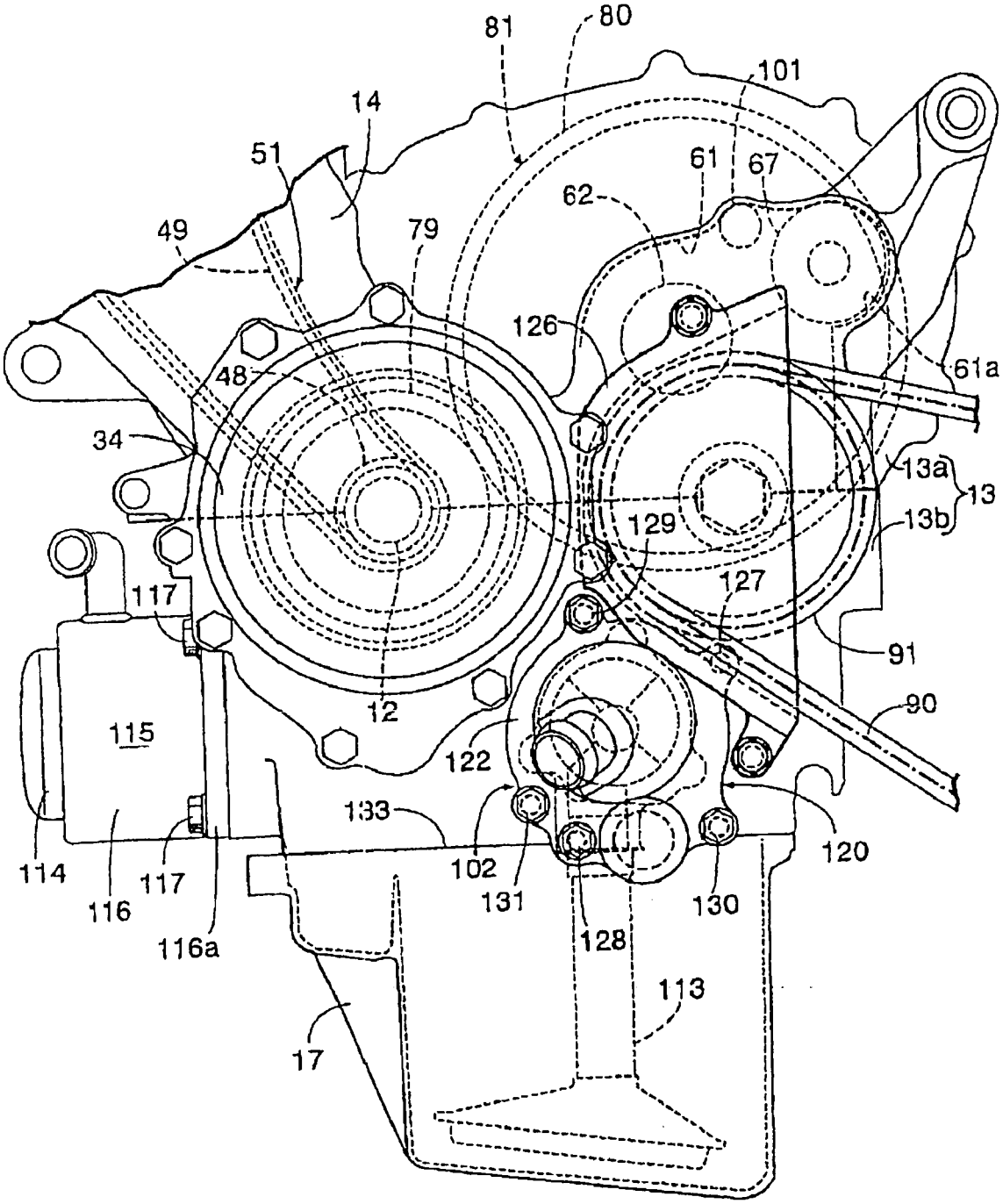
FIG. 8 is a view taken in a direction of an arrow 8 in FIG. 4.

A water pump 102 is arranged on the left side of the lower case 13*b* in the crankcase 13 between the crankshaft 12 and the counter shaft 63 as shown in FIG. 8 and an oil pump 103 coaxial with the water pump 102 is housed in a lower part of the crankcase 13.

As shown in FIG. 4, the oil pump 103 is a trochoid type, a pump housing 104 is formed by a housing main part 105 integrated with a lower part of the right lower supporting wall 71 in the lower case 13*b* and a cover 106 fastened to the housing main part 105, and an inner rotor 108 fixed to an oil pump shaft 107 rotatably penetrating the pump housing 104 and an outer rotor 109 engaged with the inner rotor 108 are housed between the housing main part 105 and the cover 106.

A driven sprocket 110 for a pump is fixed to the protruded end of the oil pump shaft 107 protruded from the housing main part 105 and a looped chain 112 is wound onto a driving sprocket 111 for a pump and the driven sprocket 110 for a pump. The driving sprocket 111 for a pump is turned integrally with the primary driven gear 80 installed on the main shaft 62 so that the primary driven gear can be relatively turned to transmit power from the crankshaft 12.

The oil pan 17 connected to the lower part of the crankcase 13 is formed so that the lateral width is narrowed in a lower part when the oil pan is viewed from a longitudinal direction of the motorcycle so as to avoid contact with road surfaces shown by chain lines LL, LR in FIG. 4 when the motorcycle is banked laterally, and an oil strainer 113 housed in the oil pan 17 is connected to a lower part of the cover 106 in the pump housing 104 of the oil pump 103. The oil pump 103 sucks oil reserved in the oil pan 17 via the oil strainer 113.

Figure 9:
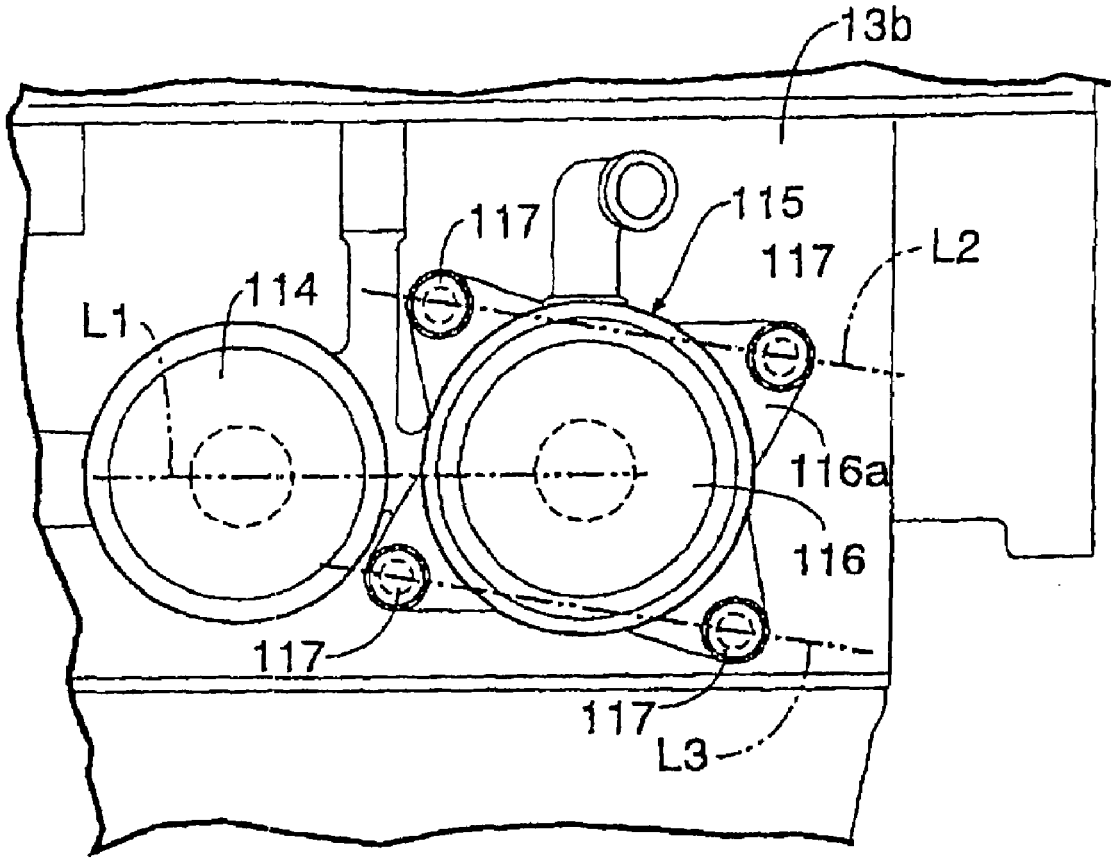
FIG. 9 is a view taken in a direction of an arrow 9 in FIG. 1.

As shown in FIG. 9, an oil filter 114 and an oil cooler 115 are attached to a front side wall in the lower case 13*b* of the crankcase 13 in a row so that a first straight line L1 tying their centers is parallel with the bonded faces of the upper and lower cases 13*a*, 13*b*.

A flange 116*a* arranged in a cooler case 116 of the oil cooler 115 is fastened to the lower case 13*b* by four bolts 117 arranged at an equal interval in a circumferential direction of the oil cooler 115, however, a pair of the bolts 117 of the four bolts 117 are arranged on a second straight line L2 inclined so that the second straight line is closer to the first straight line L1 from the oil filter 114 to the side of the oil cooler 115 above the first straight line L1, and the remaining pair of the bolts 117 of the four bolts 117 are arranged on a third straight line L3 extended in parallel with the second straight line L2 below the first straight line L1.

After oil sucked via the oil strainer 113 is supplied from the oil pump 103 to the oil filter 114, the oil purified through the oil filter 114 is led to the oil cooler 115 and is cooled, and the oil is supplied to each lubricated part of the body 11 of the engine.

As shown in FIG. 4, a pump case 120 of the water pump 102 is formed by mutually fastening a pair of case halves 121, 122 and the water pump 102 is arranged inside the driving sprocket 91 in a direction along the axis of the counter shaft 63.

The cylindrical fitting support 121*a* is provided integrally with one case half 121 of the pump case 120 and is fitted into a mounting hole 123 provided to a left side wall of the lower case 13*b* in fluid-sealing relation so that the fitting support 121*a* can be inserted/removed in a direction parallel to the axis of the counter shaft 63. A rotating vane 124 is housed in the pump case 120 and is fixed to one end of a water pump shaft 125. The water pump shaft 125 is arranged coaxially with the oil pump shaft 107 of the oil pump 103, penetrates the fitting support 121*a* in fluid-sealing relation so that the fitting support 121*a* can be rotated, and the other end of the water pump shaft 125 is protruded from the pump case 120.

In addition, a projection 107*a* protruded from one end of the oil pump shaft 107 is releasably engaged with a fitting recessed portion 125*a* provided to one end of the water pump shaft 125. That is, the oil pump 103 is driven by power transmitted from the crankshaft 12 and the water pump 102 is also driven by the power transmitted from the crankshaft 12.

A cover 126 arranged so that at least a part is overlapped with the water pump 102 from the outside when the cover is viewed from the direction along the axis of the counter shaft 63 is attached to the lower case 13*b* of the crankcase 13 to cover the driving sprocket 91.

A pair of the case halves 121, 122 forming the pump case 120 are mutually fastened by five bolts 127, 128, 129, 130, 131 at an interval in the circumferential direction, however, an extended-diameter head 127*a* of the bolt 127 arranged in a position overlapped with the chain 9 wound onto the driving sprocket 91 on a projection drawing showing a plane perpendicular to the axis of the counter shaft 63 out of the bolts 127 to 131 is arranged on the side of the crankcase 13 by being tightened through the bolt 127 from the side of the case half 121.

Both case halves 121, 121 are fastened by inserting the bolt 127 from the side of the case half 122, however, the bolts 129, 130, 131 of the residual bolts 128 to 131 also play a role in attaching the pump case 120 to the crankcase 13.

Further, the rear of the generator cover 34 is overlapped with the front of the cover 126 from the outside when the rear of the generator cover is viewed from the outside in an axial direction of the counter shaft 63, the bolt 128 is arranged under a part in which the rear of the generator cover 126 and the front of the cover 126 are overlapped, a part fastened by the bolt 128 can be efficiently arranged in space between the generator cover 34 and the cover 126 by the above-mentioned arrangement of the bolt 128, and the water pump 102 can be arranged close to the side of the crankshaft 12.

In addition, at least a part of the pump case 120 in a state in which the fitting support 121*a* is fitted into the mounting hole 123 in fluid-sealing relation and is attached to the crankcase 13 by the bolts 129 and 130, a lower part of the pump case 120 in this embodiment is protruded below a connection face 133 of the crankcase 13 and the oil pan 17 as clearly shown in FIG. 4.

Next, to explain the action of this embodiment, the shift drum 67 is arranged in the maximum outer diameter of the clutch mechanism 81 installed at the end of the main shaft 62 on the projection drawing showing the plane perpendicular to the axis of the main shaft 62 and is assembled in the crankcase 13 from the side of the clutch mechanism 81.

Therefore, as a part between the shift drum 67 and the crankcase 13 to be sealed is included in a sealed range of the clutch mechanism 81, the sealed range is not required to be extended and sealing structure to be dedicated to the shift drum 67 is not required, and the number of parts and the assembly man-hours can be reduced. In addition, walls forming the shift drum chamber 61*a* are also substantially included in the maximum outer diameter of the clutch mechanism 81 on the projection drawing showing the plane perpendicular to the axis of the main shaft 62 and hereby, the sealed range is not required to be extended.

As the transmission chamber 61 housing most of the main shaft 62, the counter shaft 63 and the shift drum 67 in the gear transmission M and operatably housing the first to sixth gear trains G1 to G6 and the shift forks 64 to 66 is formed in the crankcase 13 at the back of the crankshaft 12 in the state mounted in the motorcycle, and the shift drum chamber 61*a* forming a part of the transmission chamber 61 and housing most of the shift drum 67 is formed in the rear of the crankcase 13 in the state in which the shift drum chamber semicircularly swells toward the rear of the crankcase 13 when the shift drum chamber is viewed from the axial direction of the shift drum 67, a part except the shift drum chamber 61*a* in the transmission chamber 61 can be made compact.

As the crankcase 13 is formed by connecting the respective cast upper and lower cases 13*a*, 13*b*, the crankshaft 12 and the counter shaft 63 are rotatably supported between the bonded faces of the upper and lower cases 13*a*, 13*b* and an upper part of the transmission chamber 61 formed by the upper case 13*a* is overlapped with the clutch mechanism 81 on the projection drawing showing the plane perpendicular to the axis of the main shaft 62, the rear end of the crankcase 13 can be arranged possibly close to the axis of the counter shaft 63 in the state mounted in the motorcycle, and a part supporting the front end of a swing arm (not shown) can be arranged close to the counter shaft 63 in the motorcycle provided with the swing arm for supporting the rear wheel.

Further, the upper case 13*a* supporting both ends of the shift drum 67 forms a part of the crankcase 13 and is cast, however, as the receiving flange 100 for receiving the ball bearing 98 installed on the periphery of one end on the side of the clutch 78 of the shift drum 67 from the side of the clutch mechanism 81 is formed in the upper case 13*a*, the shift drum chamber 61*a* has the same diameter as the inner diameter of the receiving flange 100 and is cast out, the upper case 13*a* is not required to be machined to form the shift drum chamber 61*a* and the cost can be reduced. Besides, as the shift drum 67 can be assembled in the crankcase 13 from the side of the clutch mechanism 81 in a state in which the ball bearing 98 and the shift cam 103 are attached to the shift drum 67 beforehand, the efficiency of assembly and working efficiency are enhanced.

Besides, one end of the counter shaft 63 in the gear transmission M is protruded from the left of the crankcase 13, the driving sprocket 91 is provided to the protruded end of the counter shaft 63, the chain 90 for transmitting power to the driving wheel is wound onto the driving sprocket 91, and the water pump 102 arranged between the crankshaft 12 and the counter shaft 63 and arranged on the left face of the crankcase 13 is arranged inside the driving sprocket 91 in the direction along the axis of the counter shaft 63.

Therefore, the water pump 102 is not protruded outside the driving sprocket 91, the power unit can be made compact in a direction along the axis of the crankshaft 12, and the concentration of mass can contribute to the enhancement of the driving performance of the motorcycle.

Besides, as the cover 126 arranged so that at least a part is overlapped with the water pump 102 from the outside when the cover is viewed from the direction along the axis of the counter shaft 63 is attached to the crankcase 13 to cover the driving sprocket 91, the counter shaft 63 and the water pump 102 can be closely arranged, and because accessories such as the water pump 102 and the driving sprocket 91 can be also massed three-dimensionally, mass can be concentrated more.

As the main shaft 62 of the gear transmission M is arranged over a straight line tying the axis of the crankshaft 12 and the axis of the counter shaft 63, distance between the main shaft 62 and the crankshaft 12 can be reduced and the power unit can be made compact in a direction along the straight line tying the axis of the crankshaft 12 and the axis of the counter shaft 63. In addition, as the water pump 102 is arranged inside the driving sprocket 91, the position of the water pump 102 from the bottom of the crankcase 13 is lifted and the lower part of the crankcase 13 can be made compact. In the case where the water pump 102 is driven by the transmission of power from the main shaft 62 of the transmission M as in this embodiment and is driven by the transmission of power from the counter shaft 63 or the crankshaft 12, the main shaft 62, the counter shaft 63 or the crankshaft 12 and a shaft of the water pump 102 can be closely arranged, the distance of coupling by a driving member such as the chain 112 and a gear is reduced and the weight can be reduced.

Further, as the extended-diameter head 127*a* of the bolt 127 arranged in a position overlapped with the chain 90 wound onto the driving sprocket 91 on the projection drawing showing the plane perpendicular to the axis of the counter shaft 63 out of the plural bolts 127 to 130 for fastening a pair of the case halves 121, 122 forming the pump case 120 of the water pump 102 is arranged on the side of the crankcase 13, the chain 90 and the pump case 120 can be arranged closer, preventing the extended-diameter head 127*a* of the bolt 127 from interfering with the chain 90, and the power unit can be made more compact in the direction along the axis of the counter shaft 63.

As the water pump 102 is arranged inside the chain 90, the access of a tool to the water pump 102 is limited, however, the fitting support 121*a* fitted into the mounting hole 123 of the crankcase 13 is provided to the pump case 120 so that the fitting support can be inserted/removed in the direction parallel to the axis of the counter shaft 63, and the lower part which is at least a part of the pump case 120 is protruded below the connection face 133 of the crankcase 13 and the oil pan 17 when the lower part is viewed from a direction along the axis of the counter shaft 63. Therefore, even if the fitting support 121*a* of the pump case 120 is fitted to the crankcase 13, the pump case 120 can be removed from the crankcase 13 by applying force in a direction for removing the fitting support 121*a* from the crankcase 13 to the part protruded below the connection face 133 out of the pump case 120 in a state in which the oil pan 17 is removed from the crankcase 13, and the maintainability of the water pump. 102 is enhanced.

Additional Aspects of the Invention

Additional aspects of the present-invention are hereunder explained in reference to FIGS. 10 to 16. For clarity in describing these additional aspects of the invention, the reference numerals in FIGS. 10–16 have been changed, as compared to those in FIGS. 1–9.

Figure 10:
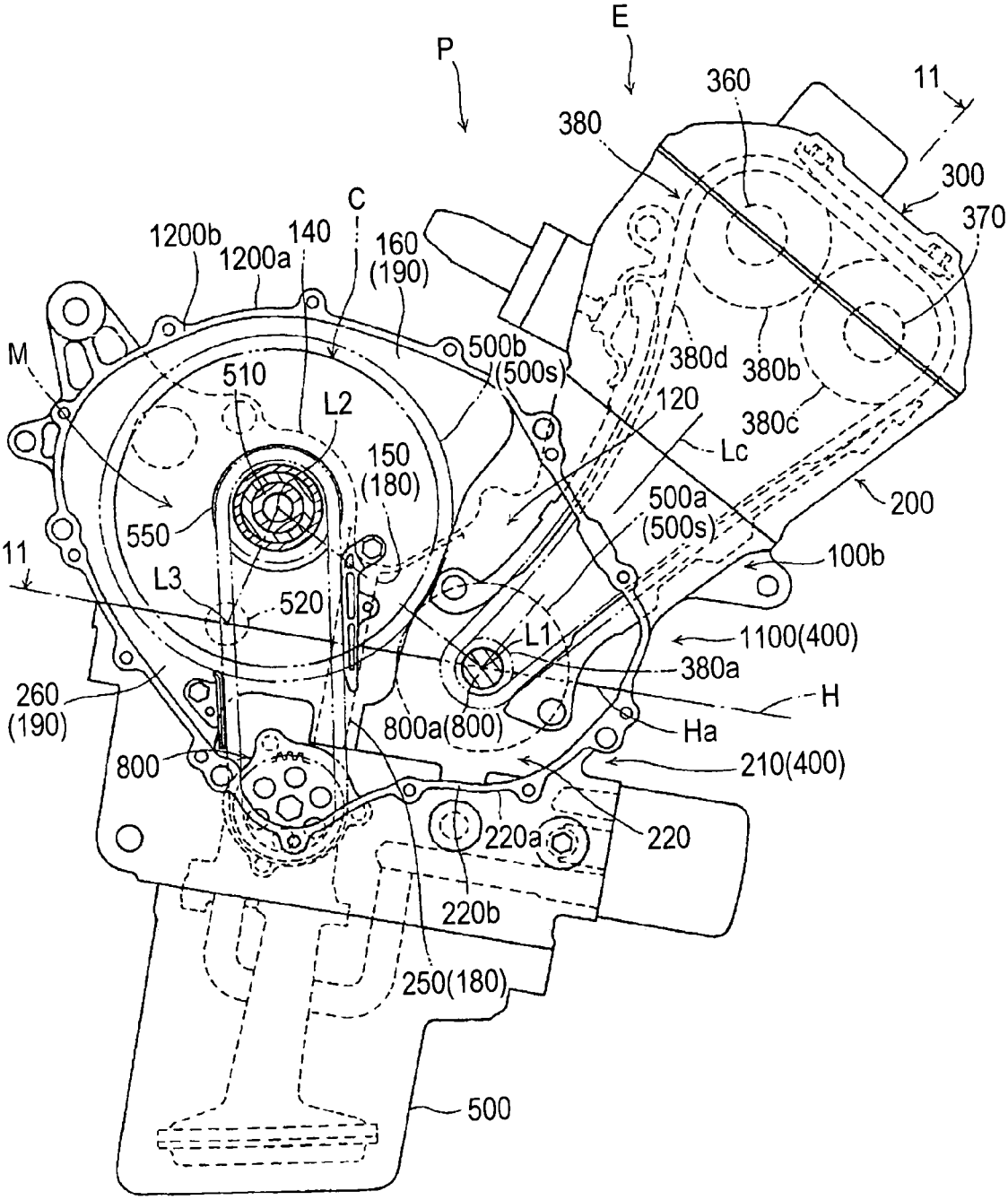
FIG. 10 is a right side view shown as a cross section generally taken on line 10—10 in FIG. 11 in the state where a crankcase cover attached to a crankcase is detached in a vehicular power unit to which the present invention is applied.
Figure 11:
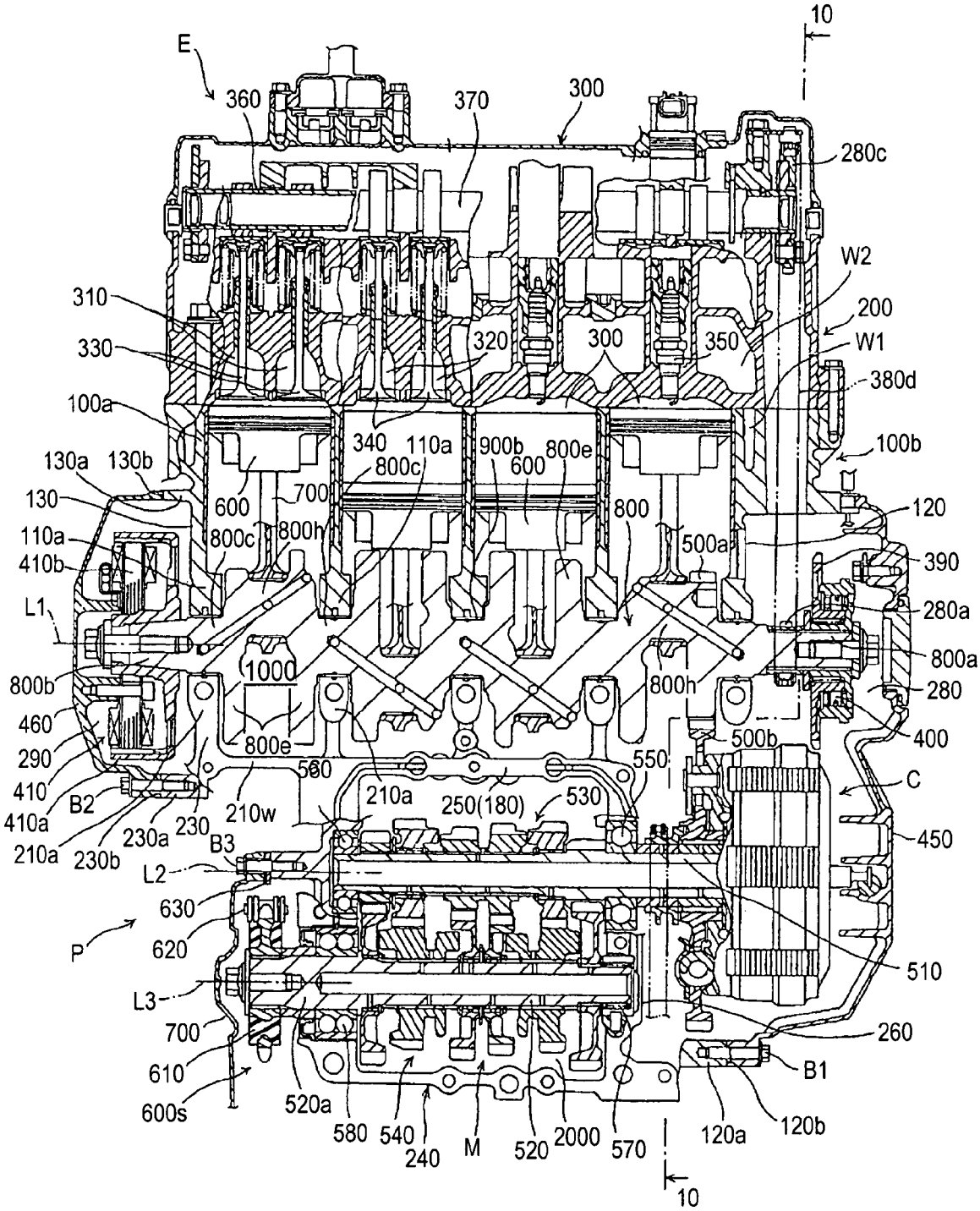
FIG. 11 is a cross sectional view generally taken on line 11—11 in FIG. 10.

Referring to FIGS. 10 and 11, a vehicular power unit P to which the present invention is applied is mounted on a motorcycle as a vehicle and equipped with a water-cooling type multi-cylinder four-stroke internal combustion engine E; a multiple disc friction clutch C as a crutch composing a power transmission device for transferring the power generated by the internal combustion engine E to a rear wheel as a driving wheel; and a constant-mesh gear transmission M as a transmission.

The internal combustion engine E mounted on a motorcycle in a transverse layout wherein the rotation center line L1 of a crankshaft 800 is directed in the vehicle width direction is equipped with an engine body comprising: a cylinder block 100*b* integrally formed by aligning four cylinders a in series; a cylinder head 200 connected to the upper end of the cylinder block 100*b*; a head cover 300 connected to the upper end of the cylinder head 200; a lower crankcase 210 connected to the lower end of the cylinder block 100*b*; and an oil pan 500 connected to the lower end of the lower crankcase 210.

Here, in the specification and the claims, the term "axial direction" means a direction parallel with the rotation center line of a crankshaft and the term "side view" means a view from the axial direction. Further, in the embodiments, the terms "front," "rear," "top," "bottom," "right," and "left" mean front, rear, top, bottom, right, and left in the state where a power unit is mounted on a vehicle, and the left side means a side on one side and the other side in the axial direction and the right side means the other side on one side and the other side in the axial direction.

A piston 600 reciprocatively fitting into each of the cylinders 1*a* is connected to the crankshaft 800 through a connecting rod 700. The crankshaft 800 installed in an internal combustion engine is housed in a crank chamber 1000 formed by a crankcase 400 which is configured by connecting an upper crankcase 110*u* as a first crankcase configured by the lower part which is a part of the cylinder block 100*b* and a lower crankcase 210 as a second crankcase. Then the crankshaft 800 is rotatably supported by the crankcase 400 at journals 800*c* via main bearings 900*b* each of which is held between bearing support walls 110*a* and 210*a* as bearing supports integrally formed with and disposed at the upper crankcase 110*u* and the lower crankcase 210 respectively; and has a rotation center line L1 on a parting plane Ha between the upper crankcase 110*u* and the lower crankcase 210.

In the cylinder head 200, for each of the cylinders 100*a*, a combustion chamber 300 formed opposite the piston 600 in the direction where a cylinder axis line Lc extends, intake ports 310 which are open to the combustion chamber 300 and opened and closed with a pair of intake valves 330, and exhaust ports 320 which are open to the combustion chamber 300 and opened and closed with a pair of exhaust valves 340 are formed, and further an ignition plug 350 facing the combustion chamber 300 is mounted. Each of the intake valves 330 and the exhaust valves 340 is opened and closed in synchronization with the rotation of the crankshaft 800 with an overhead camshaft type valve system having an intake camshaft 360 and an exhaust camshaft 370 rotatably supported by the cylinder head 200. Hence, each of the camshafts 360 and 370 is rotatably driven at a rotation speed half of the rotation speed of the crankshaft 800 with a valve driving mechanism 380 comprising: a drive sprocket 380*a* disposed at a shaft end 800*a* on the right side of the crankshaft 800; cam sprockets 380*b* and 380*c* disposed at the shaft ends on the right side of the camshafts 360 and 370; and a timing chain 380*d* hung over the sprockets 380*a*, 380*b* and 380*c*.

Gaseous mixture of intake air from an intake system and fuel: flows into each of the combustion chambers 300 through the intake ports 310 at the time of the opening of the intake valves 330; is ignited with the ignition plugs 350; and burns. The pistons 600, which are driven by the pressure of burnt gas in the combustion chambers 300 and reciprocate, rotatably drive the crankshaft 800. The burnt gas, as an exhaust gas, flows to the exhaust ports 320 at the time of the opening of the exhaust valves 340 and further is exhausted outside through an exhaust system.

To the shaft end 800*a* protruding in the axial direction (corresponding to the vehicle width direction and the right-and-left direction) from the crank chamber 1000, attached are, in order from the side of the crank chamber 1000: the drive sprocket 380*a*; and a one-way clutch 4000 for transferring the rotation of a starting driven gear 390 driven by a starter motor to the crankshaft 800. Then protruding walls 1200*a* and 220*a*, which are parts of sidewalls 1200 and 220 on the right sides of the upper crankcase 110 and the lower crankcase 210 respectively and are formed by protruding in the axial direction, compose a peripheral wall surrounding the driven gear 390 and the clutch C. To mating faces 1200*b* and 220*b* which are the end faces of the protruding walls 1200*a* and 220*a* in the axial direction, connected is a crankcase cover 450 of the right side which faces the sidewalls in the axial direction and covers the clutch C from the right side with many bolts B1. Then a storage room 280, which houses the shaft end 800*a*, the drive sprocket 380*a*, the driven gear 390, the clutch C and a driven gear 500*b* and is open to the crank chamber 1000, is formed with the crankcase cover 450 and the sidewalls 1200 and 220.

Referring to FIGS. 12(A), 12(B), 13 and 14, to a shaft end 800*b* on the left side of the crankshaft 800 protruding from the crank chamber 1000 in the axial direction, an AC generator 410 is attached as an electric generator. The AC generator 410 is connected to the shaft end 800*b* and has a rotor 410*a* having an outer diameter larger than those of crank webs 800*e* of the crankshaft 800 and a stator 410*b* fixed to a generator cover 460 as stated later. Then protruding walls 130*a* and 230*a* protruding in the axial direction on sidewalls 130 and 230 on the left sides of the upper crankcase 110*u* and the lower crankcase 210 compose a peripheral wall surrounding the AC generator 410. To mating faces 130*b* and 230*b* which are the end faces of the protruding walls 130*a* and 230*a* in the axial direction, connected with many bolts B2 is the generator cover 460 as a crankcase cover on the left side which faces the sidewalls 130 and 230 in the axial direction and covers the AC generator 410 from the left side. Then a storage room 290 which houses the shaft end 800*b* and the AC generator 410 is formed with the generator cover 460 and the sidewalls 130 and 230.

Referring to FIGS. 10 and 11, the power of the crankshaft 8 is transferred to the clutch C via a primary speed reducer 500*s* composed of a driving gear 500*a* formed integrally with the crankshaft 800 and a driven gear 500*b* meshing with the driving gear 500*a* and further transferred from the clutch C to a main shaft 510 which is the input shaft of the gear transmission M. Then a counter shaft 52 which is the output shaft of the gear transmission M outputs the power of the crankshaft 800 after subjected to speed change at an intended gear ratio with a pair of change gears selected from among main side change gear group 530 and counter side change gear group 540 by gear shifting and the power from the counter shaft 520 is transferred to a rear wheel via a secondary speed reducer 600 having a drive sprocket 610 attached to the counter shaft 520.

The main shaft 510, the counter shaft 520, and both the change gear groups 530 and 540 are housed in a transmission chamber 2000 formed by a transmission case which is configured with: an upper transmission case 140 as a first transmission case formed by a rear part which is a part of the upper crankcase 110*u*; and a lower transmission case 240 as a second transmission case formed by a rear part which is a part of the lower crankcase 210.

The transmission chamber 2000 located at the rear of the crank chamber 10: is severed from the crank chamber 1000 and the storage room 280 with a first barrier wall 180 and a second barrier wall 190 of the transmission case; and is opened downward to the oil pan 500 in the same manner as the crank chamber 1000 and the storage room 28. Here, the first barrier wall 180 is composed of protruding walls 150 and 250 of the upper transmission case 140 and the lower transmission case 240 respectively in the crankcase 400 and the second barrier wall 190 is composed of sidewalls 160 and 260 (composed of rear parts which are parts of the sidewalls 1200 and 220) of the upper transmission case 140 and the lower transmission case 240 respectively in the axial direction.

Here, the crankcase 400 formed integrally with the transmission cases is also a power unit case which is installed in the power unit P and forms the crank chamber 1000 and the transmission chamber 2000 and the power unit case houses the crankshaft 800, the main shaft 510, the counter shaft 520, and the change gear groups 530 and 540.

Figure 13:
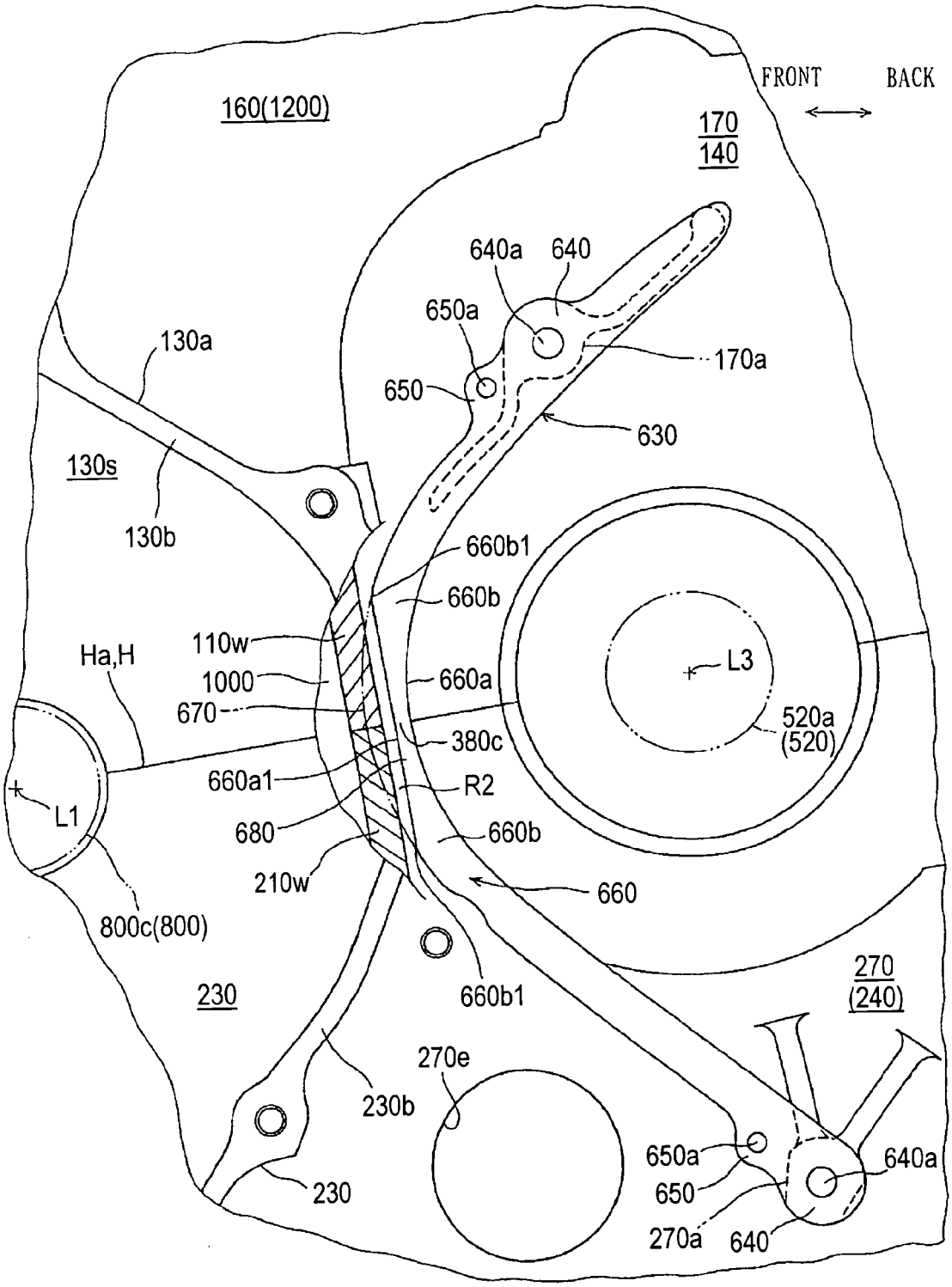
FIG. 13 is a left side view showing substantial parts of a crankcase in the state where a chain guide is disposed in the power unit shown in FIG. 10.

Referring to FIG. 13 together, the main shaft 510 of the gear transmission M is rotatably supported by the second barrier wall 190 and the sidewall 170 (a part of the sidewall 130*s* on the left side at the rear of the upper crankcase 110*u*) on the left side of the upper transmission case 140 opposing the second barrier wall 190 in the axial direction via a pair of bearings 550 and 560 respectively. The counter shaft 520 is rotatably supported by the second barrier wall 190 and the sidewall 170 of the upper transmission case 140 and the sidewall 270 (a part of the sidewall 230 on the left side at the rear of the lower crankcase 210) of the lower transmission case 240, those sidewalls opposing the second barrier wall 190 in the axial direction, via a pair of bearings 570 and 580 respectively.

The main shaft 510 and the counter shaft 520 are disposed in parallel with the crankshaft 800 at intervals in the anteroposterior direction as the arranging direction orthogonal to the axial direction at positions where they overlap with the crankshaft 800 in the axial direction; and have rotation center lines L2 and L3 respectively, which are parallel with the rotation center line L1. Then the rotation center lines L2 and L3 are located at positions equally or nearly equally distant from the rotation center line L1 respectively. Further, the rotation center line L3 of the counter shaft 520 is located on the parting plane Ha and the main shaft 510 is located above the rotation center line L1, the shaft ends 800*a* and 800*b* and the counter shaft 520. Hence, the parting plane Ha is a plane on the reference plane H including both the rotation center lines L1 and L3.

Further, the main shaft 510 is located to the rear side of the crankshaft 800 at an interval and the counter shaft 520 is located to the rear side of the main shaft 510 at a slight interval or at a position where parts of them overlap with each other in the anteroposterior direction. Hence, the main shaft 510 and the counter shaft 520 are located to the rear side of the crankshaft 800 at intervals and disposed in the relation of the anteroposterior direction to the position of the crankshaft 800. Here, a rear side means a side in one direction and the other direction of the aforementioned arranging direction and a front side means the other side in one direction and the other direction of the arranging direction.

Figure 14:
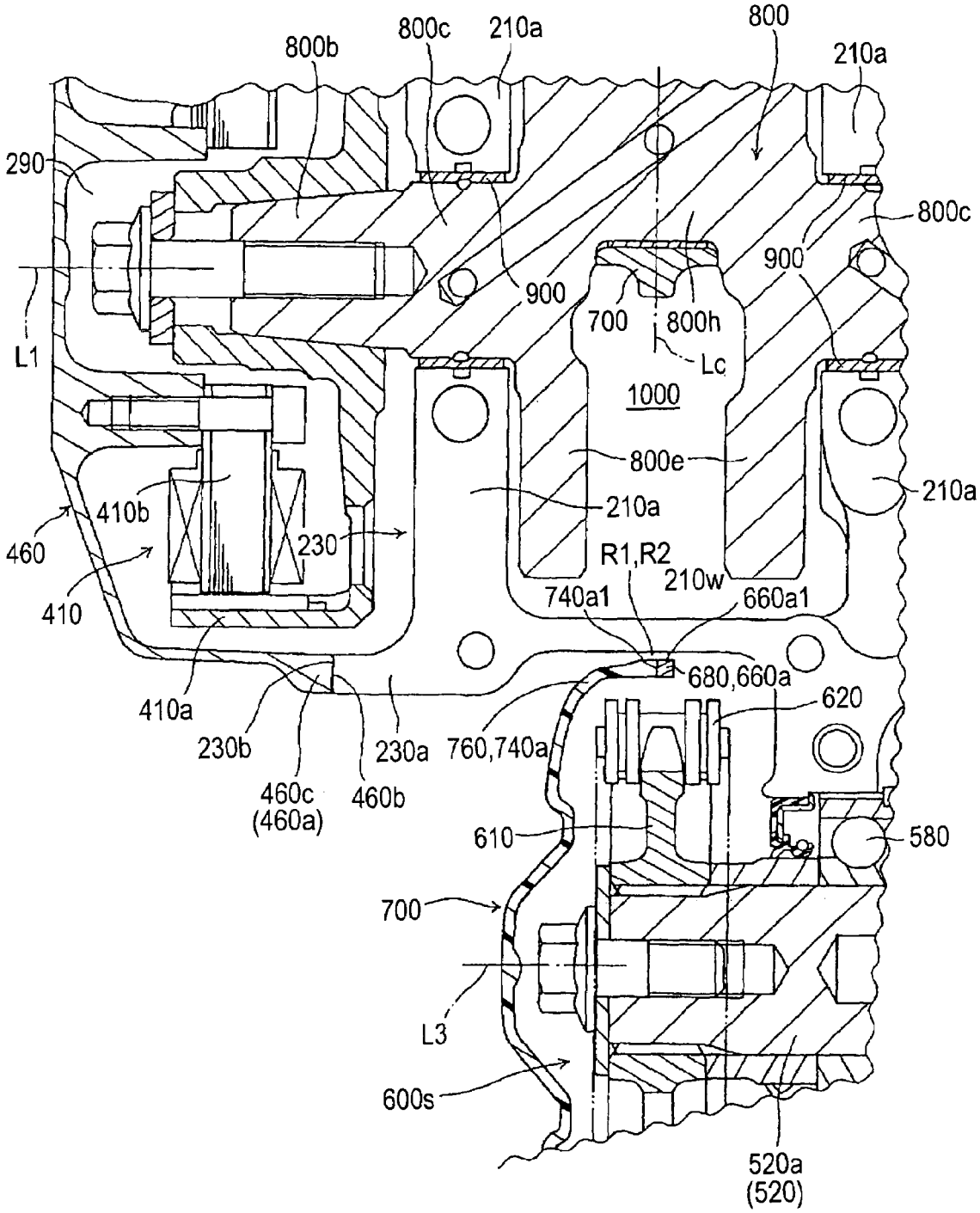
FIG. 14 is a view taken on line 14—14 in FIG. 12(A)

Referring to FIGS. 11, 13, and 14, a drive sprocket 610 which is an output driving wheel as the output retrieving member is attached to a shaft end 520*a*, on the left side, of the counter shaft 520 protruding from the transmission chamber 2000 to the axial direction. The drive sprocket 610 composes a secondary speed reducer 600*s* as an output transfer mechanism for transferring the power from the counter shaft 520 to a rear wheel together with: a driven sprocket which is an output driven wheel disposed at the rear wheel; a driving chain 620 as an output endless transmission belt hung over the driven sprocket and the drive sprocket 610; and a chain guide 630 as a traveling guide for guiding the driving chain 620 so as not to go off the drive sprocket 610.

Referring to FIGS. 11 to 13, a chain cover 700 as a protective cover is connected with bolts B3 to a pair of installation seats 170*a* and 270*a* formed at the sidewalls 170 and 270 on the left side of the upper transmission case 140 and the lower transmission case 240 in a manner of protruding in the axial direction and the chain cover 700 covers the whole of the drive sprocket 610 and a part of the driving chain 620 including the whole of a winding part 620*a*, which is the part winding the drive sprocket 610, of the drive chain 620 from the left side on a side view.

Referring to FIGS. 11, 13, and 14, the drive sprocket 610 is disposed at a position in the axial direction: where the entire drive sprocket 610 overlaps with the cylinder 100*a* adjacent to the AC generator 410 in the axial direction (hereunder referred to as "adjacent cylinder 100*a*"); or between a pair of bearing support walls 110*a*, 210*a* and 110*a*, 210*a* which respectively support a pair of journals 800*c* disposed in the manner of interposing a crank pin 800*h* to which the connecting rod 700 of the piston 600 fitting into the adjacent cylinder 100*a* is connected and a pair of crank webs 800*e*. Then the entire drive sprocket 610 is located at a position where it overlaps in the axial direction with the chamber walls 110*w* and 210*w* of the crank chamber 1000 in the direction of the radius of the crankshaft 800 the center of which is the rotation center line L1. Here, the chamber walls 100*w* and 210*w*: are composed of parts of the upper crankcase 110*u* and the lower crankcase 210 respectively; and are located between a pair of bearing support walls 110*a*, 210*a* and 110*a*, 210*a* in the axial direction. Then the drive sprocket 610 and the driving chain 620 are located: between and nearly in the center of a pair of crank webs 8*e* in the axial direction; and also at positions where they overlap with the cylinder axial line Lc of the adjacent cylinder 100*a* in the axial direction.

The chain cover 700 is disposed at a position where the entire chain cover 70 overlaps with the adjacent cylinder 100*a* in the axial direction and the whole or nearly whole of the chain cover 700 is disposed between a pair of bearing support walls 110*a*, 210*a* and 110*a*, 210*a*. Consequently, the chain cover 700 is located at a position where it does not overlap with the AC generator 410 and the generator cover 460 in the axial direction.

Figures 12A, 12B:
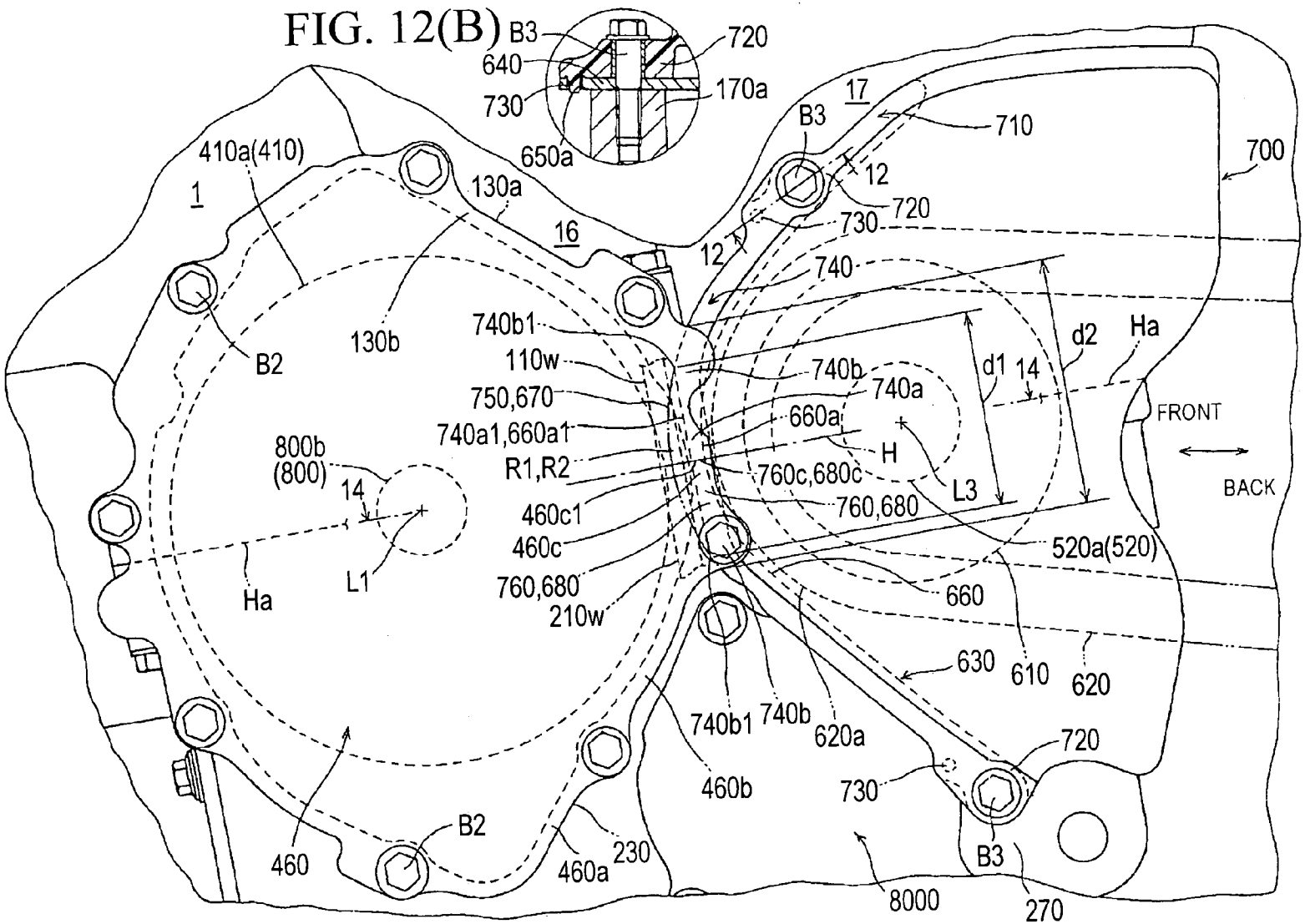
FIG. 12(A) is a left side view showing substantial parts focused on a generator cover and a chain cover of the power unit shown in FIG. 10.
FIG. 12(B) is a cross sectional view taken on line 12—12 in FIG. 12(A)

Referring to FIGS. 12(A) and 14, in the periphery of the chain cover 700, a rim 710 closer to the crankshaft 800 in the anteroposterior direction has: a pair of attaching parts 720 tightened with bolts B3 to the positions corresponding to the installation seats 170*a* and 270*a* (refer to FIG. 13); supports 730 for supporting the chain guide 630 temporarily assembled to the chain cover 700; and an arcuate part 740 which is located between the pair of the attaching parts 720 at a position on the outer side of the winding part 620*a* of the driving chain 620 in the radius direction of the rotation center line L3 which is also the rotation center line of the drive sprocket 610.

The arcuate part 740 disposed along the outer periphery of the drive sprocket 610 and between the crankshaft 800 or the chamber walls 110*w* and 210*w* and the drive sprocket 610 in the anteroposterior direction has a retracted section 740*a* of a shape retracting toward the shaft end 520*a* of the counter shaft 520 in the anteroposterior direction at a part opposing the crankshaft 800 in the anteroposterior direction or in the radius direction of the drive sprocket 610 in order to avoid interference with the chamber walls 110*w* and 210*w*. The retracted section 740*a* has an outer circumferential plane 74*a*1 which is closer to the drive sprocket 610 or the counter shaft 520 in the anteroposterior direction than to a virtual circular arc 750 which has a radius identical to the distance between the outer circumferential plane 740*b*1 the center of which is the rotation center line L3 at a pair of boundaries 740*b* with the other part of the arcuate part 740 and the rotation center line L3 on a side view.

Hence, in the retracted section 740*a*, the outer circumferential plane 740*a*1 as the outer circumference of the retracted section 740*a* on the outer side in the radius direction of the counter shaft 520 is closer to the drive sprocket 610 or the counter shaft 520 in the anteroposterior direction than to the outer circumference of the arcuate part 740 except the retracted section 740*a*. That is, the retracted section 740*a* is the part wherein the distance between the outer circumferential plane 740*a*1 and the drive sprocket 610 or the counter shaft 520 is short. Thus, parts of the chamber walls 110*w* and 210*w* intrude into a space R1 which is formed because the retracted section 740*a* retracts from the virtual circular arc 750.

A support 730 disposed in the vicinity of each of the attaching parts 720 is composed of a pin comprising a protrusion formed by protruding toward each of the installation seats 170*a* and 270*a* (refer to FIG. 13) in the axial direction in the chain cover 700 as shown in FIG. 12(B).

Referring to FIG. 13 together, the chain guide 630 covers over a halfway around the drive sprocket 61 closer to the crankshaft 800 in the anteroposterior direction. In the axial direction, the chain guide 630 disposed between the sidewalls 170, 270 and the chain cover 700 is: held between the installation seats 170*a*, 270*a* and the chain cover 700; tightened together with the chain cover 700 with the bolts B3 screwed into the installation seats 170*a* and 270*a*; and thus attached to the sidewalls 170 and 270. In this attached state, nearly all of the chain guide 630 overlaps with the rim 710 of the chain cover 700 on a side view and the outer circumference of the chain cover 700 nearly coincides with the outer circumference of the chain guide 630 on the outer side in the radius direction of the counter shaft 520.

The arcuate chain guide 630 made of a metal tabular material has: a pair of attaching parts 640 located at or in the vicinities of the ends of the chain guide 630 and tightened with the bolts B3; assembling parts 650 for temporarily assembling the chain guide 630 to the chain cover 700; and an arcuate part 660 located on the outer side of the winding part 620*a* of the driving chain 620 in the radius direction of the rotation center line L3 and between both the attaching parts 640.

Insertion holes 640*a* into which the bolts B3 are inserted are formed at both the attaching parts 640 connected to the installation seats 170*a* and 270*a* above and below the drive sprocket 610. The assembling part 650 formed in the vicinity of each of the attaching parts 640 is a part where a hole 650*a* into which the support 730 is inserted is formed. Then the supports 730 are inserted into the holes 650*a* of the assembling parts 650, and thereby the chain guide 630 is assembled and integrated with the chain cover 700 in the state of being supported by the supports 730 at the assembling parts 650 and thereafter connected with the bolts B3 to the installation seats 170*a* and 270*a* together with the chain cover 700.

The arcuate part 660 disposed between the crankshaft 800 or the chamber walls 110*w* and 210*w* and the drive sprocket 610 in the anteroposterior direction has a retracted section 660*a* of a shape retracting toward the counter shaft 520 in the anteroposterior direction at a part opposing the crankshaft 800 in the anteroposterior direction or in the radius direction of the drive sprocket 610 in order to avoid the interference with the chamber walls 110*w* and 210*w*. The retracted section 660*a*: is a part where the width of the chain guide 630 is smaller than the other part of the chain guide 630; and has an outer circumferential plane 660*a*1 which is closer to the drive sprocket 610 or the counter shaft 520 in the anteroposterior direction than to a virtual circular arc 670 which has a radius identical to the distance between the outer circumferential plane 660*b*1 the center of which is the rotation center line L3 at a pair of boundaries 660*b* with the other part of the chain guide 630 and the rotation center line L3 on a side view. Hence, in the retracted section 660*a*, the outer circumferential plane 660*a*1 as the outer circumference of the retracted section 660*a* on the outer side in the radius direction of the counter shaft 520 is closer to the drive sprocket 610 or the counter shaft 520 in the anteroposterior direction than to the outer circumference of the arcuate part 660 except the retracted section 660*a*. That is, the retracted section 660*a* is the part wherein the distance between the outer circumferential plane 660*a*1 and the drive sprocket 610 or the counter shaft 520 is short. Thus, parts of the chamber walls 110*w* and 210*w* intrude into a space R2 which is formed because the retracted section 660*a* retracts from the virtual circular arc 670. On a side view, both the outer circumferential planes 740*a*1 and 660*a*1 each of which has a linear or nearly linear shape orthogonal to the reference plane H coincide with each other and the retracted section 660*a* almost overlaps with the retracted section 740*a* at most parts thereof.

Then referring to FIG. 12, in the power unit P, the generator cover 460, the chain cover 700, and the chain guide 630 are disposed at positions where the generator cover 460 partially overlaps with the chain cover 700 and the chain guide 630 in the anteroposterior direction on a side view. More specifically, referring to FIG. 14 together, in response to the fact that the AC generator 410 is located at a position on the left side of the drive sprocket 610, the generator cover 460 is located at a position on the left side of the chain cover 70. Then on a side view, the generator cover 460, the chain cover 700 and the chain guide 630 have overlapping parts 460*c*, 760 and 680, the centers of which in the direction orthogonal to the reference plane H are the intersections 460*c*1, 760*c* and 680*c* with the reference plane H respectively, overlapping with each other in the anteroposterior direction over a width d2 which is larger than the width d1 of the retracted sections 740*a* and 660*a*.

The overlapping part 460*c* of the generator cover 460 is a part closer to the counter shaft 520 in the anteroposterior direction at a periphery 460*a* having a mating face 460*b* connected to mating faces 130*b* and 230*b*. Hence, the overlapping part 760 of the chain cover 700 and the overlapping part 680 of the chain guide 630 overlap also with the protruding walls 130*a* and 230*a* and the mating faces 130*b* and 230*b* on a side view. Meanwhile, the overlapping part 760 of the chain cover 700 is a part of the rim 710 closer to the crankshaft 800 in the anteroposterior direction and the overlapping part 760 contains the whole of the outer circumferential plane 740*a*1 and more than half of the retracted section 740*a*. Further, the overlapping part 680 of the chain guide 630 contains the whole of the retracted section 660*a*.

Further, the chamber walls 110*w* and 210*w*, which are located between the crankshaft 800 and the drive sprocket 610, the driving chain 620 and oppose the retracted sections 740*a* and 660*a* in the anteroposterior direction or in the radius direction of the counter shaft 520, are not required to have a large strength in comparison with the bearing support walls 110*a* and 210*a* (refer to FIG. 11), and hence the thickness of the chamber walls 110*w* and 210*w* can relatively be reduced. Therefore, it is possible to approximate the chain cover 700 and the chain guide 630 to the crankshaft 800 in the anteroposterior direction to the extent of the reduction of the thickness. Then the generator cover 460, the chain cover 700 and the chain guide 630 partially overlap with each other in the anteroposterior direction on a side view, thereby the chamber walls 100*w* and 210*w* are located closer to the crankshaft 800 than to the overlapping parts 460*c*, 760 and 680 and the protruding walls 130*a* and 230*a* in the anteroposterior direction, and hence the upper crankcase 110 and the lower crankcase 210 formed by casting are demolded in the direction orthogonal to the parting plane Ha.

Further, a water pump 8000 composing the cooling water system of the internal combustion engine E is disposed in the space between the generator cover 460 and the drive sprocket 610 at a position lower than the overlapping parts 460*c*, 760 and 680 (namely, closer to the oil pan 500) on a side view. The water pump 8000 attached to the lower crankcase 210 by being tightened with bolts in the state of fitting into a fitting hole 270*e* of the sidewall 270 (refer to FIG. 13) supplies cooling water with pressure to water jackets W1 and W2 (refer to FIG. 11) formed at the cylinder block 100*b* and the cylinder head 200, respectively.

Next, the functions and effects of the embodiment configured as stated above are explained.

In the power unit P, the generator cover 460 which covers the AC generator 410 facing the sidewalls 130*s* and 230 of the crankcase 400 as the power unit case and the chain cover 700 which covers the drive sprocket 610 facing the sidewalls 170 and 270 which are parts of the sidewalls 130*s* and 230 are placed at positions where they partially overlap with each other in the anteroposterior direction on a side view, thereby the generator cover 460 and the chain cover 700 have the overlapping parts 460*c* and 760 where they overlap with each other in the anteroposterior direction, hence the distance between the crankshaft 800 and the counter shaft 520 is shortened in the anteroposterior direction to the extent of the length corresponding to the overlapping parts 460*c* and 760, and resultantly the power unit P wherein the crankshaft 800 and the counter shaft 520 are disposed in parallel with each other at an interval in the anteroposterior direction can be downsized in the anteroposterior direction.

Further, by the configuration described in the items (1) to (3) shown below, the distance between the crankshaft 800 and the counter shaft 520 is shortened in the anteroposterior direction and thus the power unit P is downsized in the anteroposterior direction.

(1) The secondary speed reducer 600*s* comprises the drive sprocket 610, the driving chain 620 wound on the drive sprocket 610, and the chain guide 630 for guiding the driving chain 620, and the chain guide 630 is placed at a position where it partially overlaps with the generator cover 460 in the anteroposterior direction on a side view. By so doing, it is possible to approximate the counter shaft 520 to the crankshaft 800 in the anteroposterior direction until the generator cover 460 and the chain guide 630 have the overlapping parts 460*c* and 680 which overlap with each other in the anteroposterior direction.

(2) The chain cover 700 and the chain guide 630 have the retracted sections 740*a* and 660*a* of shapes retracting toward the counter shaft 520 at the arcuate part 660 opposing the crankshaft 800 in the anteroposterior direction in order to avoid the interference with the chamber walls 110*w* and 210*w* of the crank chamber 1000 in which the crankshaft 800 is housed. Thereby, it is possible to: dispose the chain cover 700 and the chain guide 630 close to the sidewalls 110*w* and 210*w* by making use of the spaces R1 and R2 formed by the retracted sections 740*a* and 660*a*; and hence approximate the counter shaft 520 to the crankshaft 800 in the anteroposterior direction.

(3) Further, since the chamber walls 110*w* and 210*w* intrude into the spaces R1 and R2 formed by the retracted sections 740*a* and 660*a*, it is possible to: approximate the counter shaft 520 to the crankshaft 800 in the anteroposterior direction to the extent of the length of the intrusion of the chamber walls 110*w* and 210*w* into the spaces R1 and R2; and hence further shorten the distance between the crankshaft 800 and the counter shaft 520 in the anteroposterior direction.

The outer diameter of the rotor 410*a* of the AC generator 410 is larger than the outer diameter of the crank webs 800*e* of the crankshaft 800 and the drive sprocket 610 is disposed between a pair of bearing supports 110*a*, 210*a* and 110*a*, 210*a* for supporting respectively a pair of journals 800*c* disposed in the manner of interposing the crank webs 800*e* of the crankshaft 800 belonging to the adjacent cylinder 100*a* adjacent to the AC generator 410 in the axial direction. Hence, the outer diameter of the rotor 410*a* can be increased and thereby it is possible to: increase the power generation capacity; and suppress the rotational fluctuation of the crankshaft 800 with the AC generator 410 as the rotary inertial mass while the weight of the AC generator 410 is prevented from increasing or reduced. Further, it is possible to: approximate the counter shaft 520 to the crankshaft 800 in the anteroposterior direction by utilizing the crank webs 800*e* which are smaller than the rotor 410*a*; and therefore shorten the distance between the crankshaft 800 and the counter shaft 520 in the arranging direction and downsize the power unit P in the arranging direction.

Further, since one chain guide 630 has the retracted section 660*a*, it is possible to shorten the distance between the crankshaft 800 and the counter shaft 520, for example, while avoiding using a chain guide 630 divided so that the chain guide 630 may not be disposed on the reference plane H, namely while preventing the number of parts from increasing and assembling capability from deteriorating.

Figure 15:
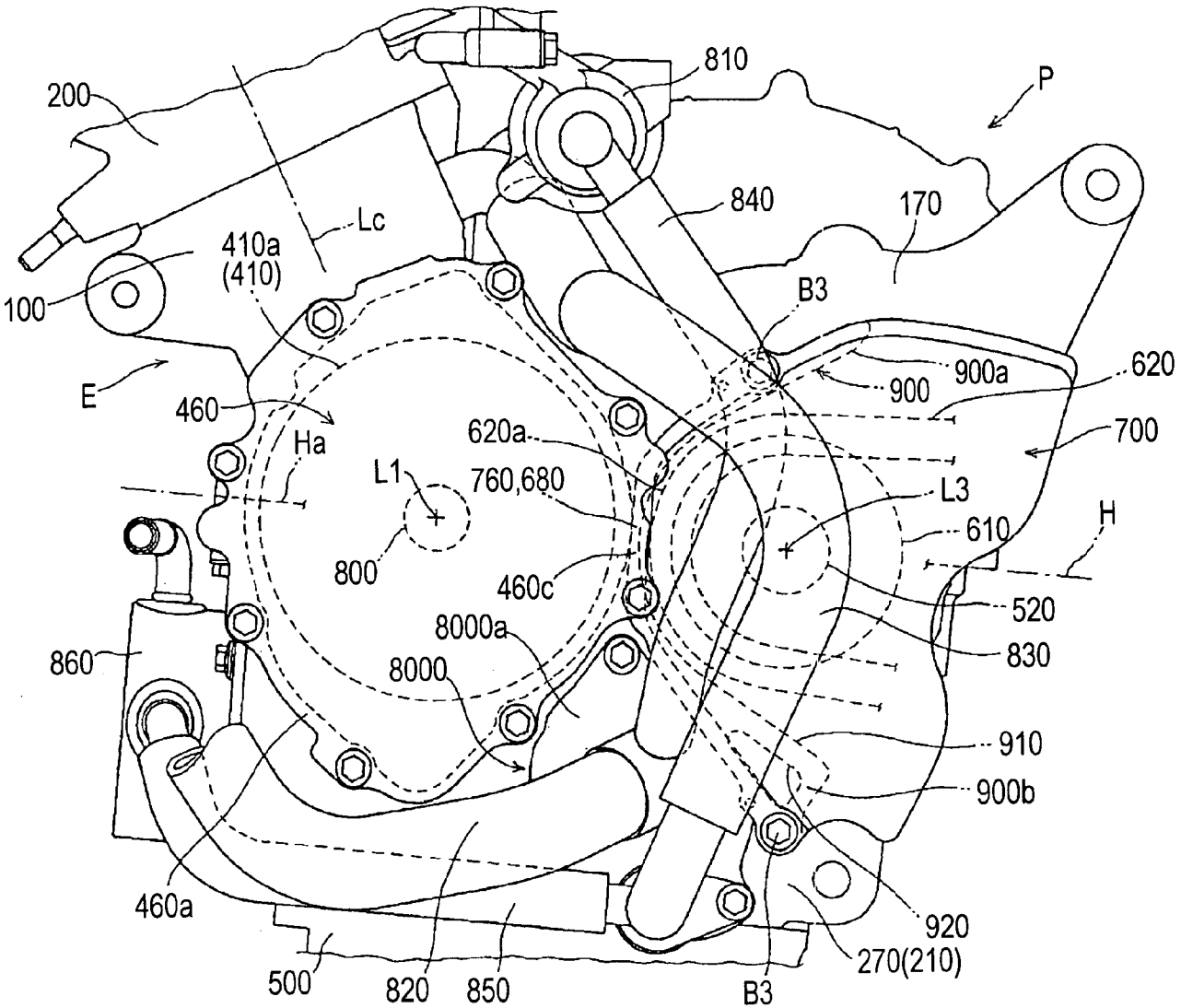
FIG. 15 is a left side view showing another embodiment according to the present invention wherein substantial parts focused on a generator cover and a chain cover in a vehicular power unit to which the present invention is applied are shown.
Figure 16:
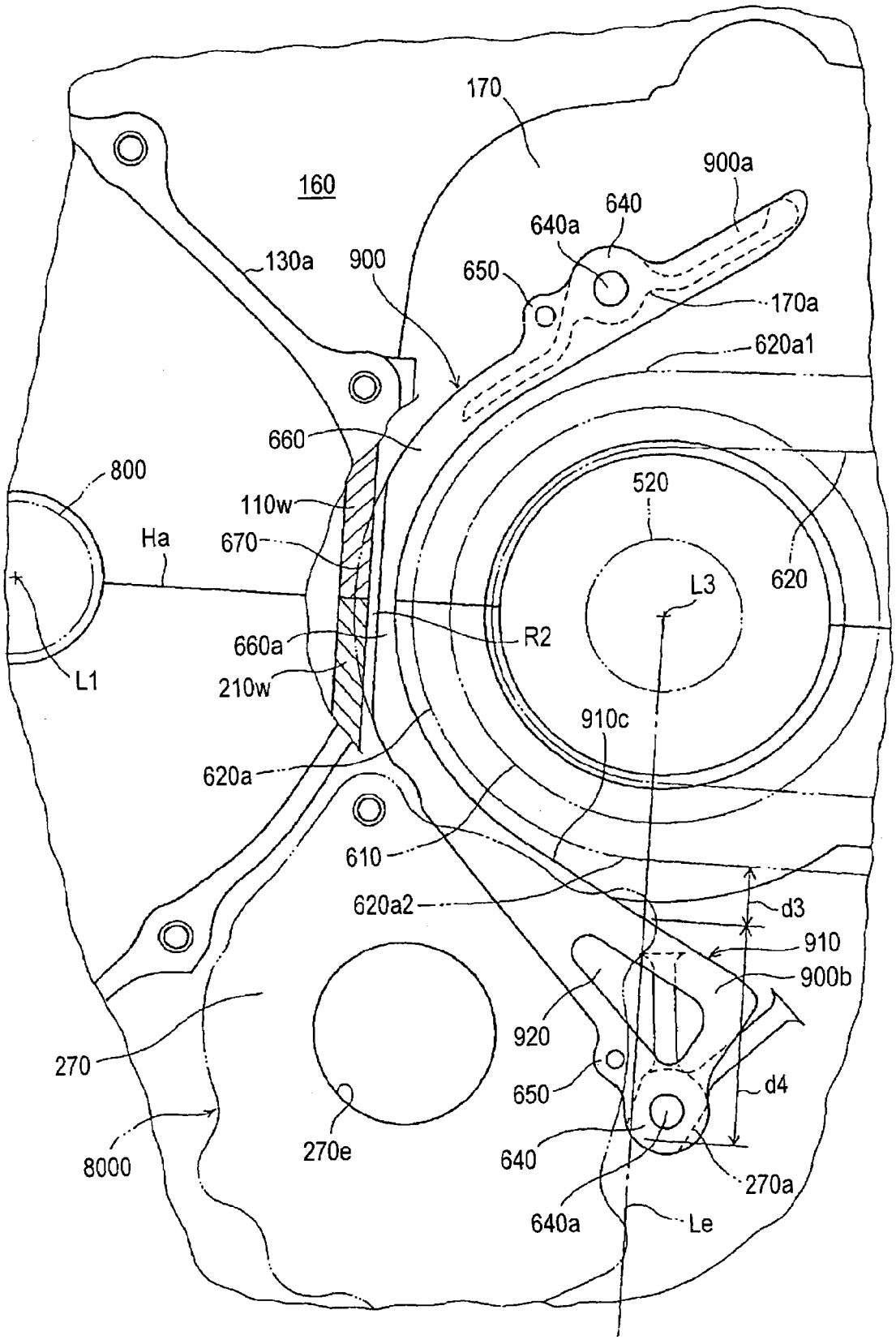
FIG. 16 is a view corresponding to FIG. 13 in the power unit shown in FIG. 15.

Next, another embodiment according to the present invention is explained in reference to FIGS. 15 and 16. This embodiment is different from the first embodiment mainly in some parts of the chain guide and basically has the same configuration as the first embodiment except the chain guide. Hence, explanations on identical parts are omitted or simplified and the explanations are focused on different points. Here, an identical reference numeral is used for a member identical or corresponding to the first embodiment according to need.

In the axial direction, a chain guide 900 disposed between the sidewalls 170, 270 and the chain cover 700 is: held between the installation seats 170*a*, 270*a* and the chain cover 700; tightened together with the chain cover 700 with the bolts B3 screwed into the installation seats 170*a* and 270*a*; and thus attached to the sidewalls 170 and 270.

The chain guide 900 includes a pair of attaching parts 640 which are disposed in the vicinities of the ends 900*a* and 900*b* of the chain guide 900 respectively and tightened together with the chain cover 700 with the bolts B3; assembling parts 650 for temporarily assembling the chain guide 900 to the chain cover 700; an arcuate part 660 which is located on the outer side of the winding part 620*a* of the driving chain 620 in the radius direction of the rotation center line L3 of the drive sprocket 610 and also between both the attaching parts 640; and a wide width part 910 at a position where it overlaps with the unwinding section 620*a*2 out of the winding section 620*a*1 and the unwinding section 620*a*2 which are both the ends of the winding part 620*a* in the circumferential direction around the rotation center line L3.

The whole or nearly whole of the wide width part 910 including the one end 620*a*2 of the chain guide 900 is covered with the chain cover 700 and parts of the wide width part 910 compose attaching parts 640. Then the distance d3 between the driving chain 620 and the opposing face 910*a* of the wide width part 910 on the half straight line Le extending from the rotation center line L3 through the unwinding section 620*a*2 is smaller than the width d4 of the wide width part 910 on the half straight line Le on a side view. Further, a window 92 opening toward both the directions of the axial direction on the inner side of the chain cover 700 is formed at a position of the wide width part 910 where it intersects with the half straight line Le. Here, the opposing face 910*a* is a plane of the inner rim, of the chain guide 900, opposing the driving chain 620 in the direction of the radius having the rotation center line L3 as the center and also a guide plane for guiding the driving chain 620.

Insertion holes 640*a* into which the bolts B3 are inserted are formed at the attaching parts 640 connected to the installation seats 170*a* and 270*a*. The arcuate part 660 has the retracted section 660*a* of a shape retracting toward the counter shaft 520 in the anteroposterior direction in order to avoid the interference with the chamber walls 110*w* and 210*w*. Parts of the chamber walls 110*w* and 210*w* intrude into the space R2 formed because the retracted section 660*a* retracts from the virtual circular arc 670.

Then the generator cover 460, the chain cover 700 and the chain guide 900 have overlapping parts 460*c*, 760, and 680 overlapping with each other respectively in the anteroposterior direction on a side view (refer to FIG. 15).

Referring to FIG. 15, the cooling system of the internal combustion engine E comprises: a water pump 8000 for supplying cooling water with pressure to the water jackets W1 and W2 (refer to FIG. 11); a thermostat 810 for controlling the flow and stop of the cooling water supplied to a radiator (not shown in the figure) in response to the warming-up state of the internal combustion engine E; and a piping group comprising hoses 820 to 850 as conduit tubes for forming a cooling water path at the exterior of the engine body, joints, and others.

The water pump 8000 attached to the lower crankcase 210 fits into a fitting hole 270*e* of the sidewall 270 (refer to FIG. 16); and has a pump body for rotatably supporting the drive shaft driven by the power of the crankshaft 8 and a pump cover 8000*a* connected to the pump body.

To the pump cover 8000*a* which, together with the pump body, forms a pump room for housing an impeller driven by the drive shaft, connected are a hose 820 for leading cooling water cooled with the radiator to the water pump 8000; a hose 830 for leading the cooling water from the water pump 8000 to a water jacket W1 of the cylinder block 1 (refer to FIG. 2); a bypass hose 840 for leading the cooling water flowing from a water jacket W2 (refer to FIG. 11) through the water jacket W1 from the thermostat 810 to the water pump 8000 without passing through the radiator at the time of the warming-up of the internal combustion engine E; and a hose 850 for an oil cooler disposed for leading the cooling water coming from the water pump 8000 to an oil cooler 860 for cooling lubrication oil discharged from an oil pump.

Further, to a thermostat 810 which is attached to the cylinder head 200 and introduces the cooling water after cooling the cylinder block 100*b* and the cylinder head 200, connected is a hose (not shown in the figure) for leading the cooling water coming from the water jacket W2 after the completion of the warming-up of the internal combustion engine E to the radiator.

Among the rubber-made hoses 820 to 850, parts of the hose 830 and the bypass hose 840 are disposed on the left side of the chain cover 700; and also across the chain cover 700 in the vertical direction at a position where the hoses overlap with the chain cover 700 and the counter shaft 520 on a side view. Then the hose 830 having an outer diameter larger than that of the hose 840: is disposed at a position where it overlaps with most part of the counter shaft 520 on a side view; and overlaps with the chain cover 700 in a range wider than the hose 840 on a side view.

Then, according to this embodiment, the following functions and effects are obtained in addition to the same functions and effects as obtained according to the first embodiment.

The chain guide 900 has the wide width part 910 at a position where it overlaps with the unwinding section 620*a*2 of the driving chain 620 in the direction of a circumference having the rotation center line L3 as the center, the distance d3 between the driving chain 620 and the wide width part 910 is smaller than the width d4 of the wide width part 910 on the half straight line Le on a side view, and the window 920 is formed at the wide width part 910. Thereby, the distance d3 can be reduced by the wide width part 910 and hence, even when the mounting angle of the internal combustion engine E on a vehicle body, namely the angle between a horizontal plane and the cylinder axis line Lc on a side view, varies, for example when a vehicular power unit P is mounted on a different vehicle, the distance d3 between the unwinding section 620*a*2 and the chain guide 900 on the half straight line Le is inhibited from increasing and hence the guide function of the chain guide 900 can be secured. Further, since the window 920 is formed at the wide width part 910, the weight of the chain guide 900 having the wide width part 910 can be reduced and, since the window 920 is located at a position where it intersects with the half straight line Le, the weight of the chain guide 900 is inhibited from increasing even when the width d4 is large. As a result, even when the mounting angle of the internal combustion engine E to a vehicle body is changed, the guide function of the chain guide 900 is maintained with the identical chain guide 900 and hence the versatility of the chain guide 900 is enhanced and the cost of the power unit P is reduced. Then by the window 920, the weight of the chain guide 900 having the wide width part 910 is reduced.

Further, since the attaching parts 640 are formed at parts of the wide width part 910, the degree of freedom of the position attached to the lower crankcase 210 can be increased by utilizing the wide width part 910 having a wide width d4 and hence the restriction to the position of the attaching parts 640 is reduced. Furthermore, since the whole or nearly whole of the wide width part 910 is disposed on the inner side of the chain cover 700 and overlaps with the chain cover 700, the intermeshing sound of the drive sprocket 610 and the driving chain 620 to the chain cover 700, namely the noise generated from the output transfer mechanism, is shielded to the extent corresponding to the overlapping and hence the sound radiated from the chain cover 700 decreases.

Since both the rubber-made hoses 830 and 840 are disposed on the outer left side of the chain cover 700 in the manner of overlapping with the chain cover 700 on a side view, the intermeshing sound of the drive sprocket 610 and the driving chain 620 coming from the chain cover 700 and the vicinity thereof is reduced. Moreover, since the hose 830 having a larger outer diameter than the hose 840 is disposed at a position where it overlaps with most part of the counter shaft 520 on a side view and overlaps with the chain cover 700 in a wider range than the hose 840 on a side view, the effect of noise reduction further improves.

With regard to embodiments wherein parts of the configurations of the aforementioned embodiments are modified, the modified configurations are explained hereunder.

The endless transmission belt may be substituted with a belt and in the case the driving wheel is a driving pulley. Further, when the output transfer mechanism has a drive shaft, the output retrieving member is an output gear attached to the output shaft.

The power unit case may comprise the crankcase forming the crank chamber and a transmission case which is separated from the crankcase.

Although the wide width part 910 composes the end 900*b*, which is one end of the chain guide 900, on the side of the unwinding section 620*a*2, the wide width part 910 may be the one which composes the end 900*a* on the side of the winding section 620*a*1, instead. Further, the chain guide 900 may have a wide width part 910 at each of both the ends 900*a* and 900*b*.

The power unit may be mounted on a vehicle in the manner of directing the rotation center line of the crankshaft to a direction different from the vehicle width direction.

The invention being thus described, it will be obvious that the same maybe varied in many ways. Such variations are not to be regarded as a departure from the spirit and scope of the invention, and all such modifications as would be obvious to one skilled in the art are intended to be included within the scope of the following claims.

What is claimed is:

1. A vehicular power unit provided with an engine (E) in which a crankshaft is rotatably supported by a crankcase and a transmission (M) housed in the crankcase for shifting power transmitted from the crankshaft, the vehicular power unit comprising:

a drive-side transmission sprocket wheel provided to an end of an output shaft of the transmission (M) that protrudes from one side of the crankcase;

an endless transmission belt wound around the drive-side transmission sprocket wheel, the endless transmission belt for transmitting power to a driving wheel;

a water pump arranged on the one side of the crankcase in a position that is between the crankshaft and the output shaft, wherein the water pump is arranged inside the drive-side transmission sprocket wheel in a direction along an axis of the output shaft.

2. The vehicular power unit according to claim 1, further comprising:

a cover attached to the crankcase for covering the drive-side transmission sprocket wheel, wherein at least a part of the cover is overlapped with the water pump from an outside when the cover is viewed from a direction along the axis of the output shaft.

3. The vehicular power unit according to claim 2, further comprising:

an input shaft of the transmission (M) arranged over a straight line tying an axis of the crankshaft and the axis of the output shaft.

4. The vehicular power unit according to claim 2, further comprising:

a plurality of bolts for mutually fastening a pair of case halves forming a pump case of the water pump, wherein one of the plurality of bolts has an extended-diameter head on the side of the crankcase, wherein the extended-diameter head on the side of the crankcase is in a position overlapped with the endless transmission belt, when shown on a projection drawing showing a plane perpendicular to the axis of the output shaft.

5. The vehicular power unit according to claim 1, wherein the pump case of the water pump includes a fitting support fitted to the crankcase so that the fitting support can be inserted/removed in a direction parallel to the axis of the output shaft, wherein at least a part of the pump case protrudes below a connection face of the crankcase and an oil pan when it is viewed from a direction along the axis of the output shaft.

6. A vehicular power unit provided with an engine (E) in which a crankshaft is rotatably supported by a crankcase and a transmission (M) housed in the crankcase for shifting power transmitted from the crankshaft, the vehicular power unit comprising:

a drive-side transmission sprocket wheel provided to an end of an output shaft of the transmission (M) that protrudes from one side of the crankcase;

an endless transmission belt wound around the drive-side transmission sprocket wheel, the endless transmission belt for transmitting power to a driving wheel;

a generator cover for covering a generator facing the one side of the crankcase; and a protective cover for covering the sproket wheel facing the one side of the crankcase, wherein the generator cover and the protective cover are disposed at positions where they partially overlap with each other in an arranging direction on a side view.

7. The vehicular power unit according to claim 6, further comprising a traveling guide for guiding the endless transmission belt, wherein the traveling guide is disposed at a position where it partially overlaps with the generator cover in the arranging direction on a side view.

8. The vehicular power unit according to claim 7, wherein the protective cover or the traveling guide has a retracted section of a shape retracting toward the output shaft at an arcuate part opposing the crankshaft in the arranging direction, thereby avoiding interference with a chamber wall of a crank chamber in which the crankshaft is housed.

9. The vehicular power unit according to claim 7, wherein the traveling guide has a wide width part at a position where it overlaps with an unwinding section or a winding section of the endless transmission belt in a direction of a circumference around a rotation center line of the driving wheel, wherein a distance between the endless transmission belt and a wide width part on a half straight line extending from the rotation center line through the unwinding section or the winding section is smaller than a width of the wide width part on the half straight line on a side view; and wherein a window is formed at the wide width part.

10. The vehicular power unit according to claim 6, wherein an outer diameter of a rotor of the generator is larger than an outer diameter of crank webs of the crankshaft; and the driving wheel is disposed between a pair of bearing supports for respectively supporting a pair of journals disposed so as to interpose the crank webs of the crankshaft which belong to a cylinder adjacent to the generator at a position in the axial direction.

11. A vehicular power unit provided with an engine (E) in which a crankshaft is rotatably supported by a crankcase and a transmission (M) housed in the crankcase for shifting power transmitted from the crankshaft, the vehicular power unit comprising:

a drive-side transmission sprocket wheel provided to an end of an output shaft of the transmission (M) that protrudes from one side of the crankcase;

an endless transmission belt wound around the drive-side transmission sprocket wheel, the endless transmission belt for transmitting power to a driving wheel;

a water pump arranged on the one side of the crankcase in a position that is between the crankshaft and the output shaft, wherein the water pump is arranged inside the drive-side transmission sprocket wheel in a direction along an axis of the output shaft, and wherein a water pump shaft is arranged coaxially with a shaft of an oil pump.

12. The vehicular power unit according to claim 11, further comprising:

a cover attached to the crankcase for covering the drive-side transmission sprocket wheel, wherein at least a part of the cover is overlapped with the water pump from an outside when the cover is viewed from a direction along the axis of the output shaft.

13. The vehicular power unit according to claim 12, further comprising:

an input shaft of the transmission (M) arranged over a straight line tying an axis of the crankshaft and the axis of the output shaft.

14. The vehicular power unit according to claim 12, further comprising:

a plurality of bolts for mutually fastening a pair of case halves forming a pump case of the water pump, wherein one of the plurality of bolts has an extended-diameter head on the side of the crankcase, wherein the extended-diameter head on the side of the crankcase is in a position overlapped with the endless transmission belt, when shown on a projection drawing showing a plane perpendicular to the axis of the output shaft.

15. The vehicular power unit according to claim 11, wherein the pump case of the water pump includes a fitting support fitted to the crankcase so that the fitting support can be inserted/removed in a direction parallel to the axis of the output shaft, wherein at least a part of the pump case protrudes below a connection face of the crankcase and an oil pan when it is viewed from a direction along the axis of the output shaft.

16. The vehicular power unit according to claim 11, further comprising:

a generator cover for covering a generator facing the one side of the crankcase; and a protective cover for covering the sproket wheel facing the one side of the crankcase, wherein the generator cover and the protective cover are disposed at positions where they partially overlap with each other in an arranging direction on a side view.

17. The vehicular power unit according to claim 16, further comprising a traveling guide for guiding the endless transmission belt, wherein the traveling guide is disposed at a position where it partially overlaps with the generator cover in the arranging direction on a side view.

18. The vehicular power unit according to claim 17, wherein the protective cover or the traveling guide has a retracted section of a shape retracting toward the output shaft at an arcuate part opposing the crankshaft in the arranging direction, thereby avoiding interference with a chamber wall of a crank chamber in which the crankshaft is housed.

19. The vehicular power unit according to claim 17, wherein the traveling guide has a wide width part at a position where it overlaps with an unwinding section or a winding section of the endless transmission belt in a direction of a circumference around a rotation center line of the driving wheel, wherein a distance between the endless transmission belt and a wide width part on a half straight line extending from the rotation center line through the unwinding section or the winding section is smaller than a width of the wide width part on the half straight line on a side view; and wherein a window is formed at the wide width part.

20. The vehicular power unit according to claim 16, wherein an outer diameter of a rotor of the generator is larger than an outer diameter of crank webs of the crankshaft; and the driving wheel is disposed between a pair of bearing supports for respectively supporting a pair of journals disposed so as to interpose the crank webs of the crankshaft which belong to a cylinder adjacent to the generator at a position in the axial direction.

* * * * *